US011332985B1

(12) United States Patent
Slack

(10) Patent No.: US 11,332,985 B1
(45) Date of Patent: May 17, 2022

(54) LOCKOUT MECHANISM FOR GRIPPING TOOL

(71) Applicant: NOETIC TECHNOLOGIES INC., Edmonton (CA)

(72) Inventor: Maurice W. Slack, Edmonton (CA)

(73) Assignee: Noetic Technologies Inc., Edmonton (CA)

( * ) Notice: Subject to any disclaimer, the term of this patent is extended or adjusted under 35 U.S.C. 154(b) by 0 days.

(21) Appl. No.: 17/432,831

(22) PCT Filed: Feb. 6, 2021

(86) PCT No.: PCT/CA2021/000008

§ 371 (c)(1),
(2) Date: Aug. 20, 2021

(87) PCT Pub. No.: WO2021/174333

PCT Pub. Date: Sep. 10, 2021

Related U.S. Application Data

(60) Provisional application No. 62/971,733, filed on Feb. 7, 2020.

(51) Int. Cl.
*E21B 19/07* (2006.01)

(52) U.S. Cl.
CPC ..... *E21B 19/07* (2013.01)

(58) Field of Classification Search
CPC ..... E21B 19/06; E21B 19/07; E21B 31/18; E21B 31/20

(Continued)

(56) References Cited

U.S. PATENT DOCUMENTS 2,507,127 A * 5/1950 True ..... E21B 19/06 294/86.17
3,275,368 A * 9/1966 Plunk ..... E21B 31/18 294/86.3

(Continued)

FOREIGN PATENT DOCUMENTS

WO 2019014747 A1 1/2019
WO 2020146936 A1 7/2020

OTHER PUBLICATIONS

International Search Report re PCT/CA2021/000008, completed by the ISA/CA on Apr. 12, 2021, and mailed by the ISA/CA dated May 12, 2021.

(Continued)

*Primary Examiner* — Dean J Kramer
(74) *Attorney, Agent, or Firm* — Donald V. Tomkins

(57) ABSTRACT

A secondary latch mechanism (also referred to as a lockout mechanism) for a gripping tool, such as a casing running tool (CRT), prevents activation of the CRT prior to full insertion of a tubular workpiece into the CRT. When embodied in a CRT, the lockout mechanism prevents activation of the CRT unless a fully-inserted tubular workpiece applies a selected axial load to a bumper mounted on the CRT. The lockout mechanism is operable between a locked state and an unlocked state. In the locked state, the lockout mechanism prevents relative axial movement between the CRT cage and mandrel, and keeps the CRT slips retracted away from the workpiece. When in the unlocked state, there is no significant restriction to the normal movement of the CRT components, and the CRT functions as if the lockout mechanism were not present.

8 Claims, 20 Drawing Sheets

(58) Field of Classification Search
USPC ..... 294/86.18, 86.2, 86.25, 86.3
See application file for complete search history.

(56) References Cited

U.S. PATENT DOCUMENTS

| | | | | |
|---|---|---|---|---|
| 7,909,120 | B2 | 3/2011 | Slack | |
| 8,424,939 | B2 | 4/2013 | Slack | |
| 9,869,143 | B2 * | 1/2018 | Slack | E21B 3/022 |
| 9,896,891 | B2 * | 2/2018 | Mullins | E21B 19/00 |
| 10,081,989 | B2 | 9/2018 | Slack | |
| 2006/0243444 | A1 | 11/2006 | Brisco et al. | |
| 2013/0146298 | A1 * | 6/2013 | Ellison | E21B 33/038<br>166/338 |

OTHER PUBLICATIONS

Written Opinion of the International Searching Authority re PCT/CA2021/000008, completed by the ISA/CA on Apr. 13, 2021, and mailed by the ISA/CA dated May 12, 2021.

* cited by examiner

LOCKOUT MECHANISM FOR GRIPPING TOOL

FIELD

The present disclosure relates in general to tools or devices for gripping either the outward or inward facing surfaces of a workpiece. In particular, the present disclosure relates to oilfield tools, such as casing running tools (CRTs), used to grip pipe, pipe couplings, or other tubular items with large tolerances and with surface finishes typical of as-rolled steel, particularly in circumstances where premature activation of the CRT prior to full insertion of the workpiece into the CRT would be undesirable.

BACKGROUND

U.S. Pat. No. 7,909,120 (Slack) describes mechanically-activated tools for gripping tubular articles or workpieces, and improvements to such tools are described in the following patent documents:

U.S. Pat. No. 8,424,939 (Slack);

U.S. Pat. No. 10,081,989 (Slack);

International Publication No. WO 2019/014747 A1 (Slack); and

International Publication No. WO 2020/146936 A1 (Slack).

CRTs based upon some of or all the above documents incorporate a rotary (primary) latch mechanism that prevents activation of the CRT when in the latched position and permits activation of the CRT when unlatched. Unlatching the primary latch mechanism may require some torque reaction, some compressive axial load, or other remotely-controlled means. After the primary latch mechanism is unlatched, the cage of the CRT may move axially relative to the mandrel of the CRT and cause the slips assembly of the CRT to grip the workpiece. Due to the variable nature of drilling rig operations, pipe characteristics, and human interaction with the drilling rig environment, the primary latch mechanism may become unintentionally unlatched during pipe handling operations, including casing running and casing drilling, and thus result in undesirable activation of the CRT.

A typical normal activation operating sequence for a CRT involves the following steps:

1. lowering the CRT onto the workpiece;
2. setting down vertical compressive load onto the bumper of the CRT to generate friction between the bumper and the casing;
3. applying right-hand torque and rotation to the CRT to unlatch the rotary (primary) latch mechanism; and
4. raising the CRT to allow the CRT cage to move axially relative to the CRT mandrel, which causes the CRT's slip assembly to simultaneously extend radially into engagement with the surface of the workpiece.

It is advantageous to reduce the time required to activate the CRT to decrease well construction time and cost. This can be accomplished either operationally or mechanically. One method used by drillers to increase operating speed is to rotate the CRT while lowering it onto the workpiece, thus merging the first three steps of the normal activation sequence into a single step, which eliminates the associated transition time between set-down and rotation. Another method for increasing operating speeds is to mechanically eliminate the need to rotate the CRT after set-down through use of a rotary latch release mechanism such as that described in WO 2019/014747 A1 and WO 2020/146936 A1. Both of these methods for reducing the time to activate the CRT can increase the risk of unintentional and undesirable CRT activation resulting from contact with a workpiece prior to full insertion of the workpiece into the CRT or from general contact with other objects.

For purposes of this document, a CRT configured for gripping an internal surface of a tubular workpiece will be referred to as a CRTi, and a CRT configured for gripping an external surface of a tubular workpiece will be referred to as a CRTe. The mandrel of a CRTi and the bell of a CRTe serve similar functions, and for that reason either of these elements may be alternatively referred to herein as a CRT mandrel.

BRIEF SUMMARY OF THE DISCLOSURE

In general terms, the present disclosure teaches non-limiting embodiments of a secondary latch mechanism (alternatively referred to herein as a lockout mechanism) that prevents activation of a gripping tool, such as a CRT, prior to full insertion of a tubular workpiece (e.g., a section of pipe) into the gripping tool. When embodied in a CRT, the lockout mechanism prevents activation of the CRT unless a selected axial load is applied to the CRT bumper by the end of a fully-inserted workpiece.

In the remainder of this specification, lockout mechanisms will be described for exemplary purposes in the context of mechanically-activated casing running tools (CRTs) generally as disclosed in U.S. Pat. No. 7,909,120, and the terms CRT, CRTe, and CRTi will refer to such casing running tools unless specifically stated otherwise.

The lockout mechanism has two operational states, namely, a locked state and an unlocked state, and incorporates means for transitioning between these two operational states. In the locked state, the lockout mechanism resists relative axial movement between the CRT cage and the CRT mandrel, and keeps the CRT slips retracted away from the workpiece. The unlocked state is characterized by the absence of any significant restriction to the normal movement of the components of the CRT. In the unlocked state, the CRT functions as if the lockout mechanism were not present.

There are two separate means for transitioning the lockout mechanism from the locked state to the unlocked state:

1. Application of axial load to the CRT bumper that exceeds an axial biasing force provided by a bumper spring comprising one or more bumper spring elements; and
2. Optionally, application of a hoist load (which may also be generated by torque) to the lockout mechanism that exceeds a selected threshold.

The lockout mechanism will return to the locked state from the unlocked state when the following operational sequence is performed:

1. The CRT slips are retracted from the workpiece by application of set-down load, requisite torque, or other means;
2. The primary latch mechanism of the CRT is placed in the latched position by application of requisite set-down load and rotation; and
3. The CRT is raised so that the CRT bumper no longer contacts the upper end of the workpiece.

In general terms, a lockout mechanism in a CRT in accordance with the present disclosure comprises:

a CRT bumper slidingly mounted to the CRT cage and operable to axially stroke between a first (or locked) position to a second (or unlocked) position, with the CRT bumper being biased by a bumper spring configured to provide an axial biasing force sufficient to resist a selected axial load when the CRT bumper is moved from the locked position to the unlocked position by contact with the end of the workpiece;

one or more lock pins a lock pin guide hole through the CRT cage wall for each lock pin, for receiving the lock pin and guiding it between its locked and unlocked positions;

one or more mandrel pockets (which may be provided in the form of one or more grooves) in the CRT mandrel, configured for receiving the lock pins when the lockout mechanism is in the locked state; and one or more bumper pockets (which may be provided in the form of one or more grooves) in the CRT bumper, configured for receiving the lock pins when the lockout mechanism is in the unlocked state.

As used in the present disclosure, the term "bumper spring" is intended to be understood as denoting an element or apparatus capable of providing an axial biasing force, and which therefore may take any functionally suitable form without departing for the scope of the present disclosure. Non-limiting examples of a bumper spring in accordance with the present disclosure include coil springs, wave springs, Belleville washer stacks, air springs, and hydraulic chambers connected to accumulators.

The mandrel pockets and the holes through the CRT cage wall are arranged such that the lock pins in their locked positions will prevent relative axial movement between the CRT mandrel and the CRT cage, and will hold the CRT cage in a position relative to the CRT mandrel where the CRT slips are retracted away from the workpiece.

The mandrel pockets include a cam surface configured to induce movement of the lock pins toward their unlocked positions when the CRT cage moves axially relative to the CRT mandrel in the direction that causes the CRT slips to engage the workpiece.

The bumper pockets include a cam surface configured to induce movement of the lock pins toward their locked position due to an axial force applied to the CRT bumper by the bumper spring. The stiffness and length of the bumper spring are selected such that the bumper spring provides sufficient axial force to hold the lock pins in their locked positions when no workpiece is in contact with the CRT bumper.

When a pipe or other tubular workpiece applies an axial force to the CRT bumper exceeding the axial biasing force of the bumper spring, the CRT bumper will move to its unlocked position, permitting the lock pins to move from their locked position to their unlocked position, and into the bumper pockets. The axial biasing force of the bumper spring is determined by the spring stiffness and pre-load. If the primary latch mechanism of the CRT is unlatched and the CRT is raised while the CRT bumper is in its unlocked position, then the CRT cage will be able to move axially relative to the CRT mandrel such that the slips will engage the workpiece. If the primary latch mechanism of the CRT is latched and the CRT is raised while the CRT bumper is in its unlocked position, then the CRT cage will not be able to move axially relative to the CRT mandrel, so the bumper spring will urge the CRT bumper to return to its locked position and urge the lock pins to return to their locked positions.

The lockout mechanism may be configured with a mechanical linkage acting between the bumper and the primary latch mechanism such that axial force applied by the workpiece on the bumper in excess of the axial biasing force of the bumper spring generates torque urging the primary latch mechanism to unlatch. Non-limiting examples of mechanical linkages that convert axial force (and associated linear motion) to torque (and associated rotary motion) include mating helical threads and helical track followers.

The lockout mechanism may be configured to automatically unlock at a selected combined torque and axial load envelope (alternatively referred to herein as a lockout release envelope), provided that the selected lockout release envelope is sufficient to unlatch the primary latch of the CRT. The lockout release envelope required to automatically unlock the lockout mechanism will be determined by the force balance on the lock pins—which includes the selected taper angles of the cam surfaces of the bumper pockets and mandrel pockets, and the axial biasing force of the bumper spring. The taper angle of the cam surfaces in the bumper pockets and mandrel pockets may be selected to remain constant, or to vary along the length of the cam surface to alter the axial and radial components of the contact forces with the lock pins as the mechanism components move relative to each other.

BRIEF DESCRIPTION OF THE DRAWINGS

Embodiments in accordance with the present disclosure will now be described with reference to the accompanying figures, in which numerical references denote like parts, and in which.

DETAILED DESCRIPTION

Exemplary Embodiment Incorporated into a CRTe

FIGS. 1 through 6 schematically illustrate the operation of one embodiment of a lockout mechanism in accordance with the present disclosure, and incorporated into a CRTe 120 generally in accordance with the teachings of U.S. Pat. No. 7,909,120.

Figure 1:
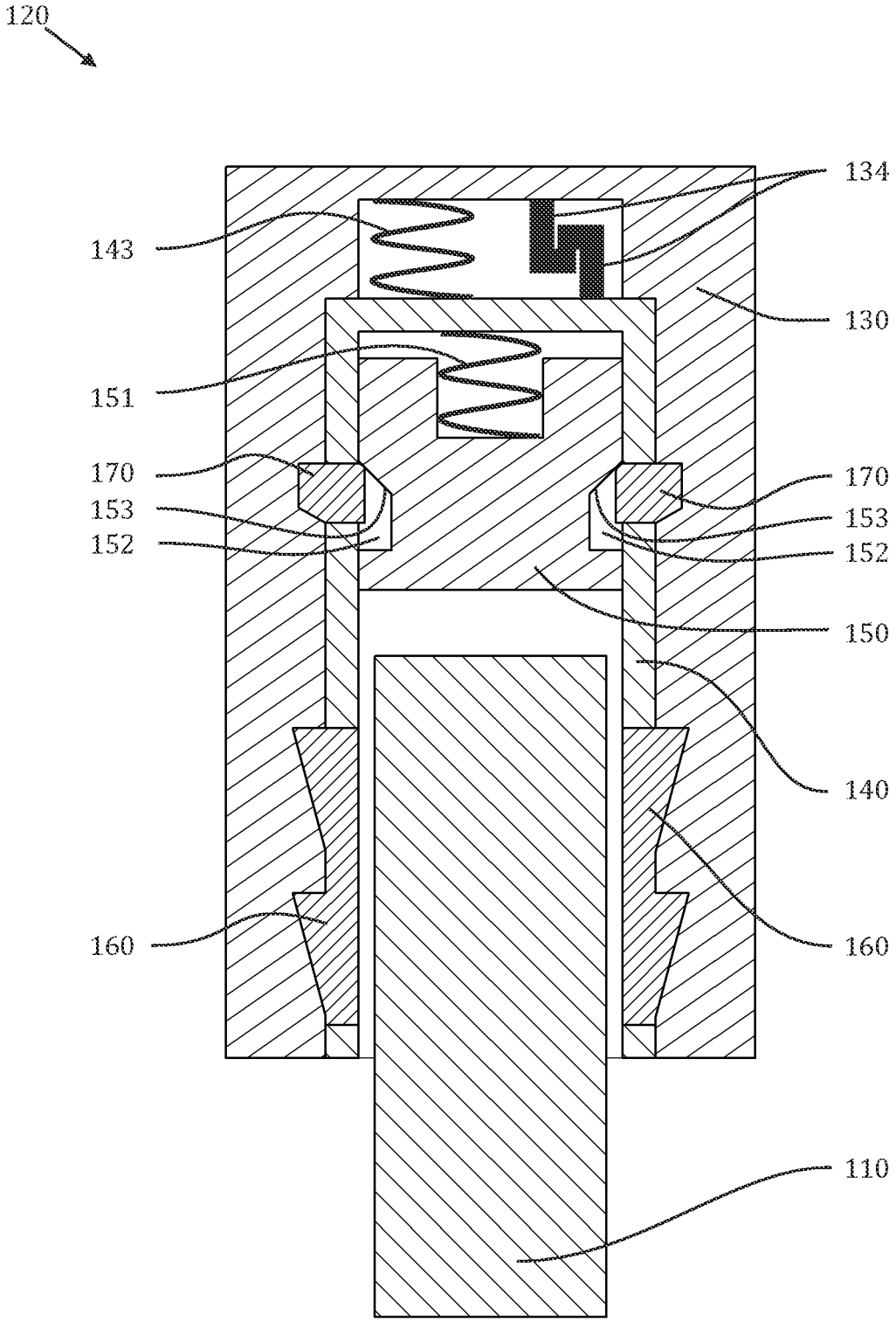
FIG. 1 is a schematic view of an exemplary embodiment of a lockout mechanism in accordance with the present disclosure and incorporated into a CRTe, with the CRTe being shown lowered onto a tubular workpiece and prior to the top of the workpiece contacting the CRT bumper.

FIG. 1 is a schematic view showing CRTe 120 as it is being lowered by the top drive of a drilling rig (not shown) onto a workpiece 110 (such as a section of pipe), and prior to the top of workpiece 110 contacting the bumper 150 of CRTe 120. Bumper spring 151 urges bumper 150 and lock pins 170 toward their respective locked positions. Cage spring 143 (which may be an air spring) is compressed between CRT mandrel 130 and CRT cage 140. Primary latch mechanism 134 is in its latched position, preventing CRT cage 140 from moving axially away from CRT mandrel 130 due to the force of compressed cage spring 143. CRT slips 160 are fully retracted away from workpiece 110.

Figure 2:
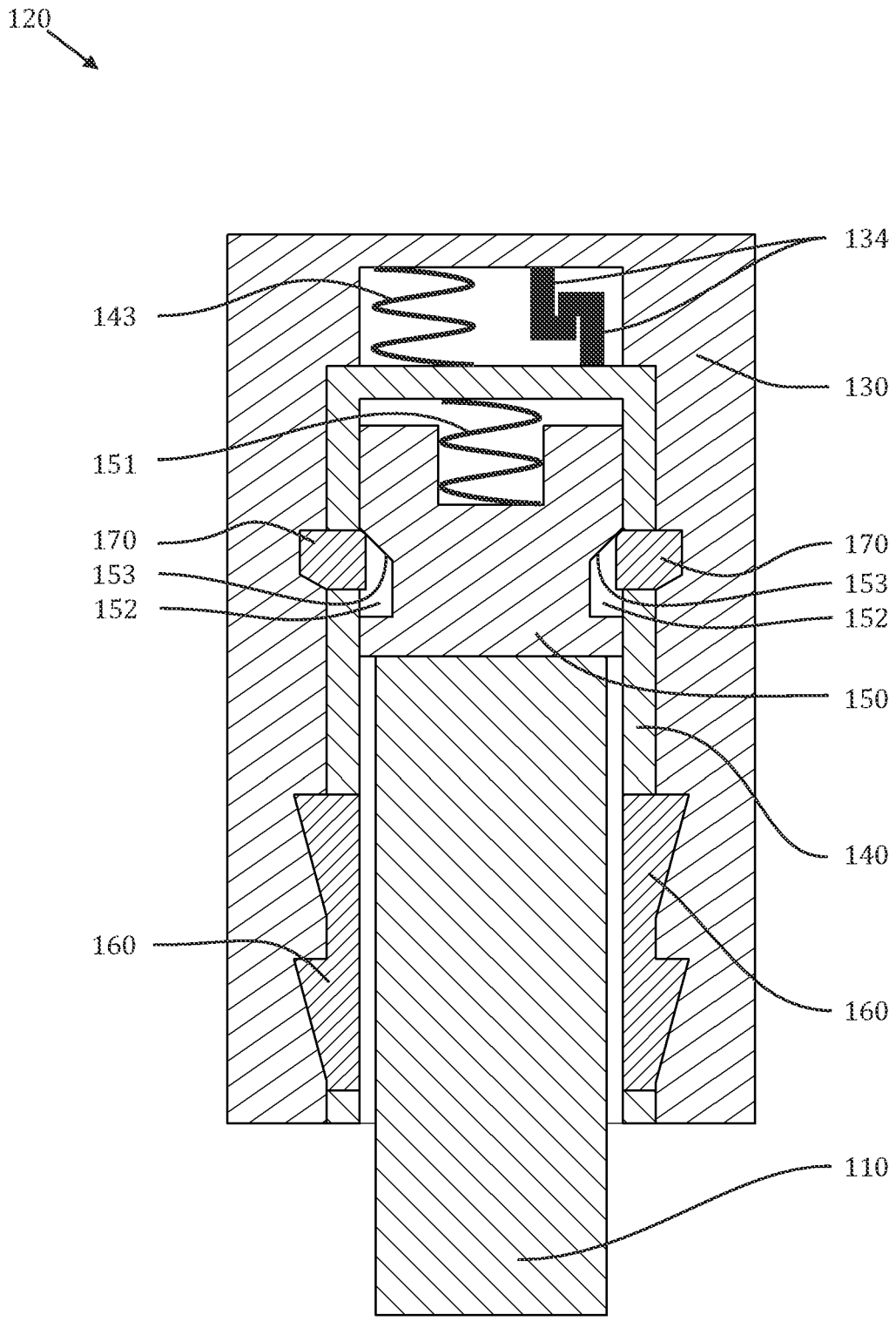
FIG. 2 is a schematic view of the lockout mechanism in FIG. 1, shown when the top of the workpiece contacts the CRT bumper without sufficient force to compress the bumper spring.

FIG. 2 is a schematic view of CRTe 120 after it has been further lowered such that the top of workpiece 110 contacts CRT bumper 150 without sufficient force to compress bumper spring 151.

Figure 3:
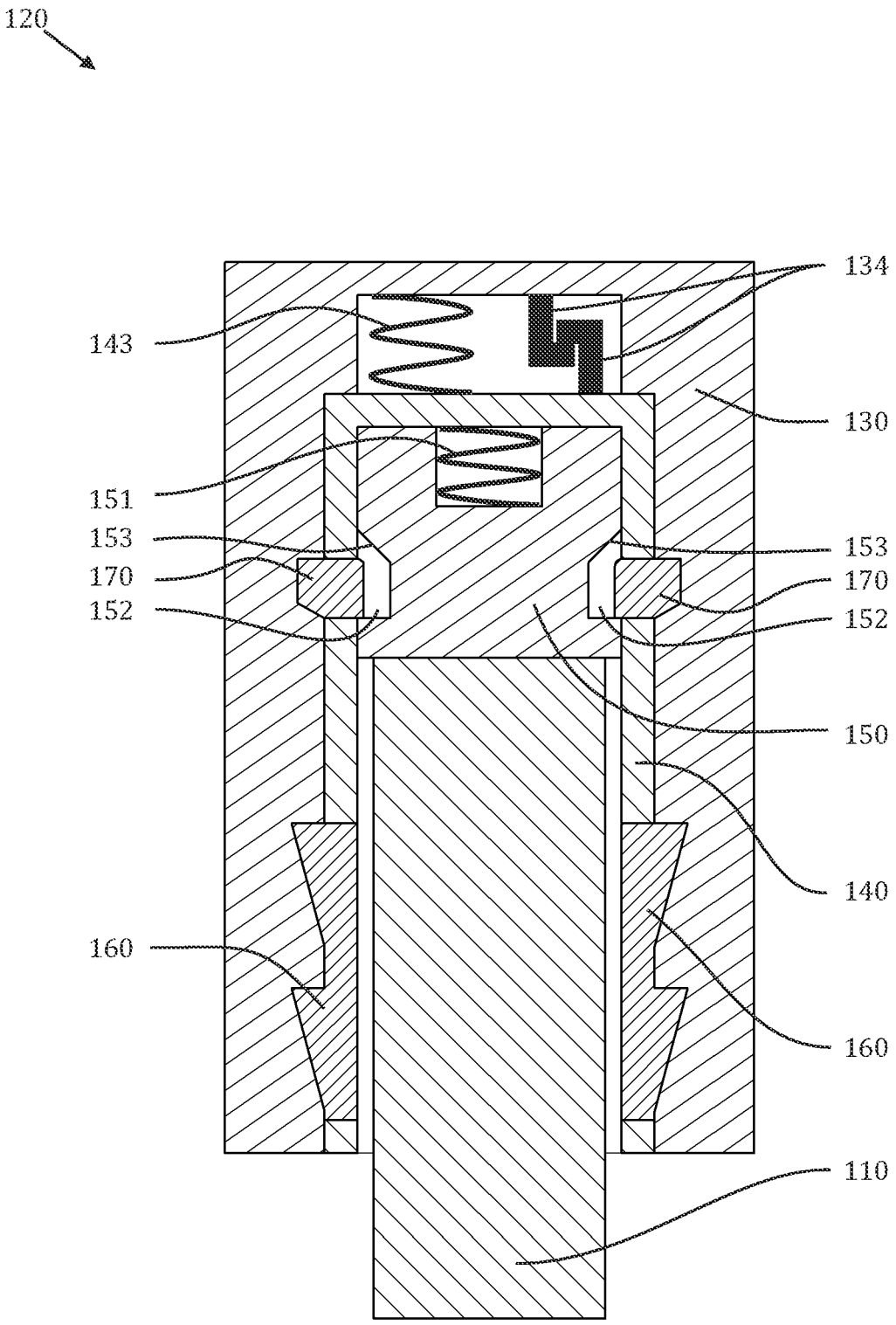
FIG. 3 is a schematic view of the lockout mechanism in FIG. 1, shown when the CRT bumper has stroked to its unlocked position and the bumper spring is compressed.

FIG. 3 is a schematic view of CRTe 120 shown at the point when CRTe 120 has been further lowered such that bumper spring 151 is compressed and CRT bumper 150 is in its unlocked position relative to CRT cage 140. Primary latch mechanism 134 (which is a rotary latch mechanism) can be unlatched by using the top drive to apply set-down load and then to rotate CRT mandrel 130 in a first direction.

Figure 4:
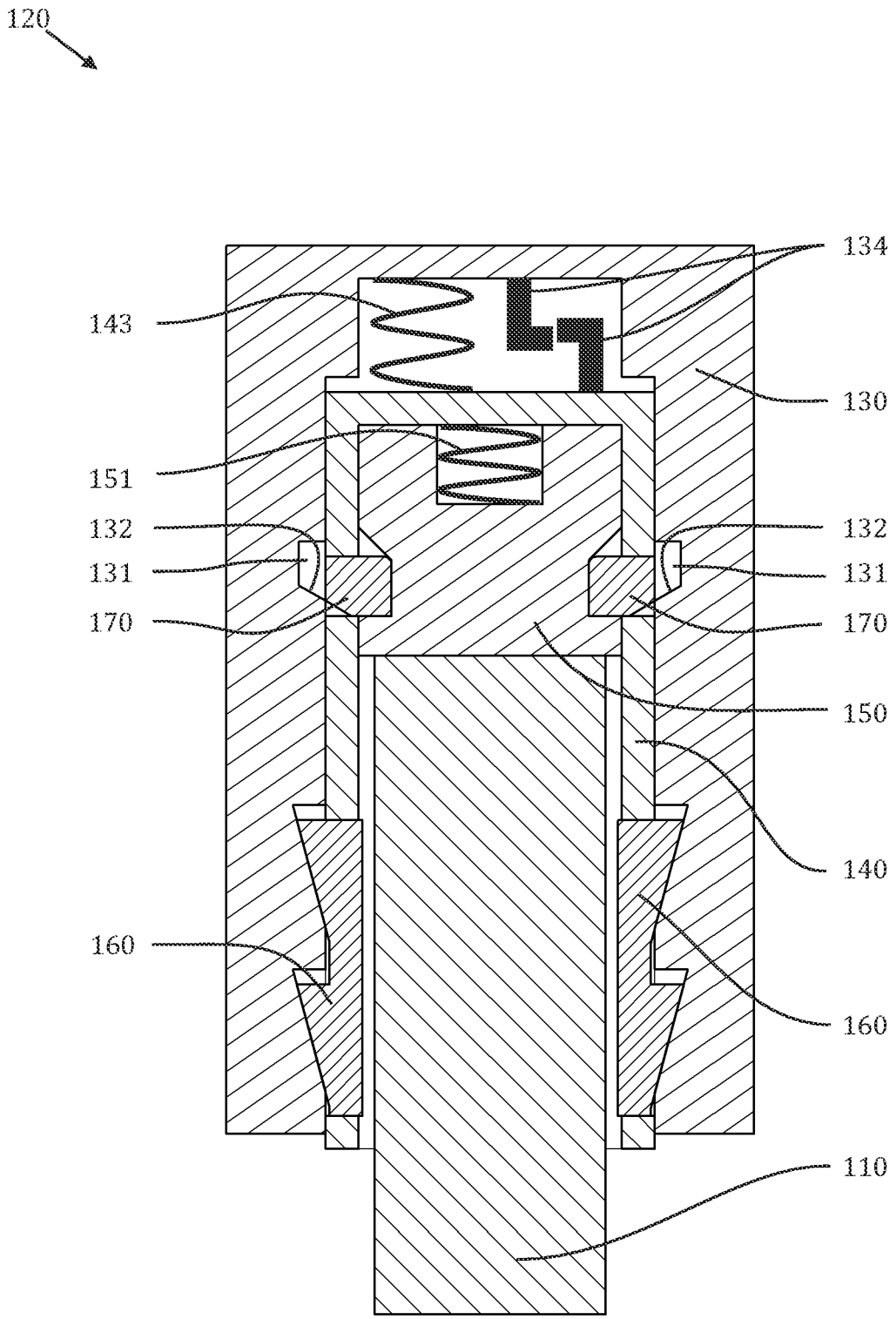
FIG. 4 is a schematic view of the lockout mechanism in FIG. 1, shown after the primary latch mechanism has been unlatched and the CRTe has been raised sufficiently to cause the lock pins to move from their locked positions to their unlocked positions.

FIG. 4 is a schematic view of CRTe 120 shown after primary latch mechanism 134 has been unlatched, and after CRTe 120 has been raised sufficiently to cause the lock pins 170 to move from their locked positions to their unlocked positions, urged by cam surfaces 132 of mandrel pockets 131 in CRT mandrel 130 and received by bumper pockets 152 in CRT bumper 150. Due to the relative axial motion between CRT mandrel 130 and CRT cage 140, CRT slips 160 extend toward workpiece 110.

Figure 5:
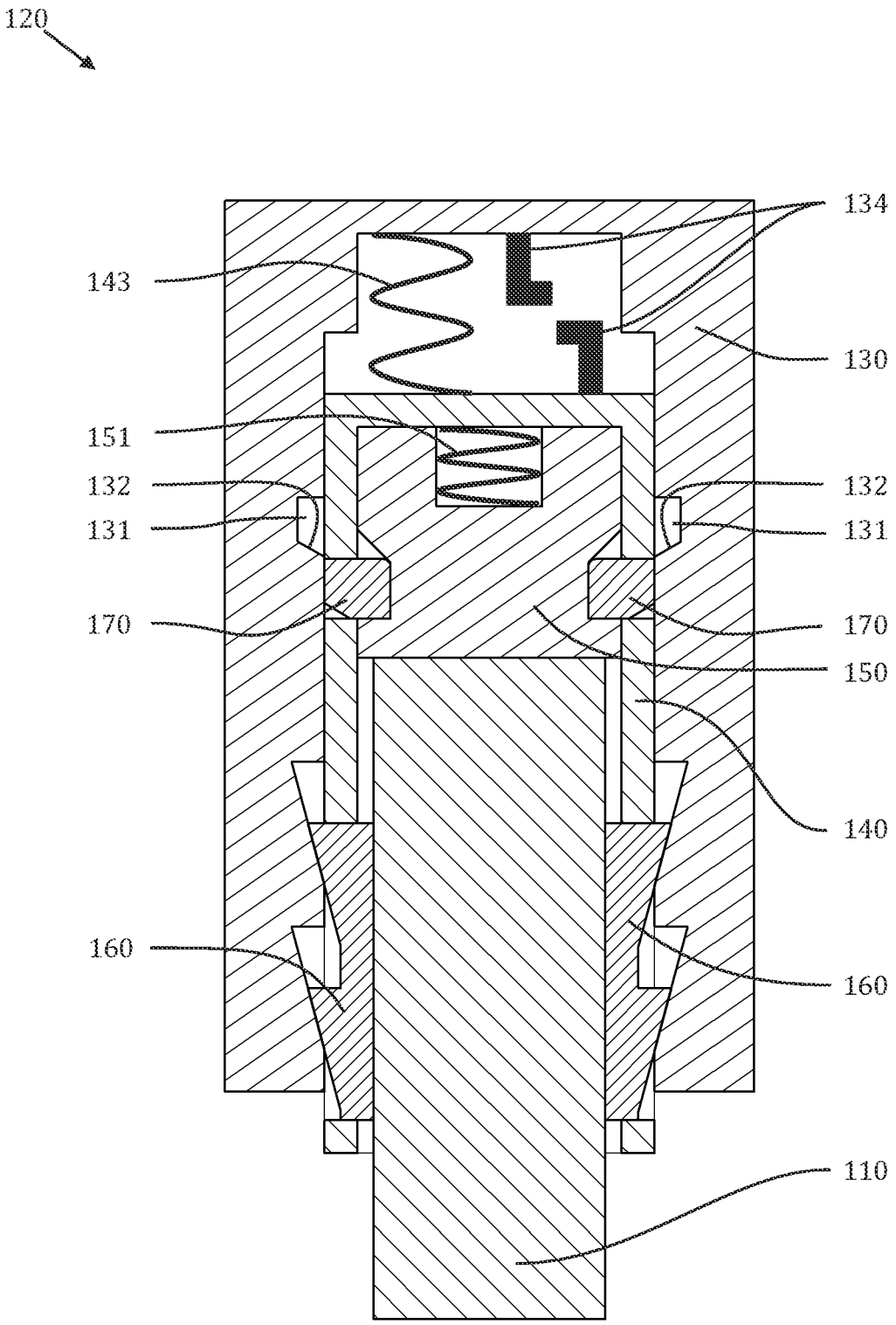
FIG. 5 is a schematic view of the lockout mechanism in FIG. 1, shown when the CRTe has been raised sufficiently to cause the slips of the CRTe to engage the workpiece.

FIG. 5 is a schematic view of CRTe 120 at the point where it has been raised sufficiently to cause CRT slips 160 to engage workpiece 110.

Figure 6:
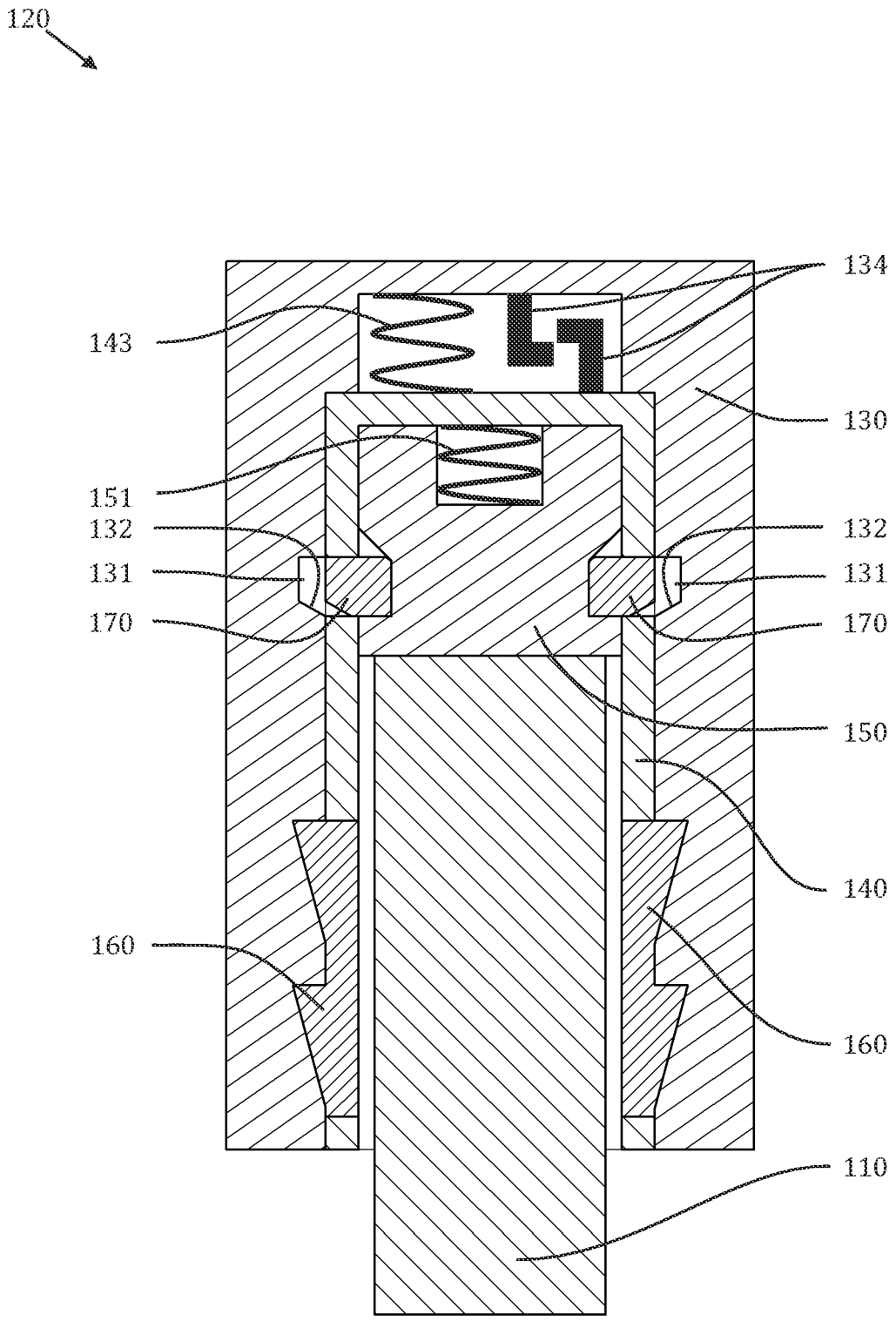
FIG. 6 is a schematic view of the lockout mechanism in FIG. 1, shown after the CRT has been lowered to release the workpiece.

FIG. 6 is a schematic view of CRTe 120 after it has been lowered to release workpiece 110. Primary latch mechanism 134 can be latched by applying set-down load and rotating CRT mandrel 130 in a second direction. After primary latch mechanism 134 has been latched, raising CRTe 120 will allow CRT bumper 150 to move to its locked position relative to CRT cage 140, urged by bumper spring 151. Cam surfaces 153 of bumper pockets 152 urge lock pins 170 to their locked position, received by mandrel pockets 131 in CRT mandrel 130. The state of CRTe 120 will then have returned to the state shown in FIG. 2.

If CRTe 120 is rotated while being lowered onto workpiece 110 and is misaligned with workpiece 110, then torque and axial load may be transmitted through contact between CRT slips 160 and workpiece 110 prior to workpiece 110 contacting CRT bumper 150. If the combined torque and axial load transmitted through the contact between CRT slips 160 and workpiece 110 is sufficient to unlatch the primary latch mechanism, the lockout mechanism will prevent relative axial movement between CRT cage 140 and CRT mandrel 130, which would extend CRT slips 160 toward workpiece 110.

The lockout mechanism may be configured to automatically unlock at a selected combined axial load and torque envelope (alternatively referred to as the lockout release envelope). The lockout release envelope is determined by the force balance on lock pins 170, which includes the selected taper angles of cam surface 153 of bumper pockets 152 and cam surface 132 of mandrel pockets 131, and the axial biasing force of bumper spring 151.

Exemplary Embodiment Incorporated into a CRTi

FIGS. 7 through 12 schematically illustrate the operation of an exemplary embodiment of a lockout mechanism in accordance with the present disclosure, and incorporated into a CRTi 220 generally in accordance with the teachings of U.S. Pat. No. 7,909,120.

Figure 7:
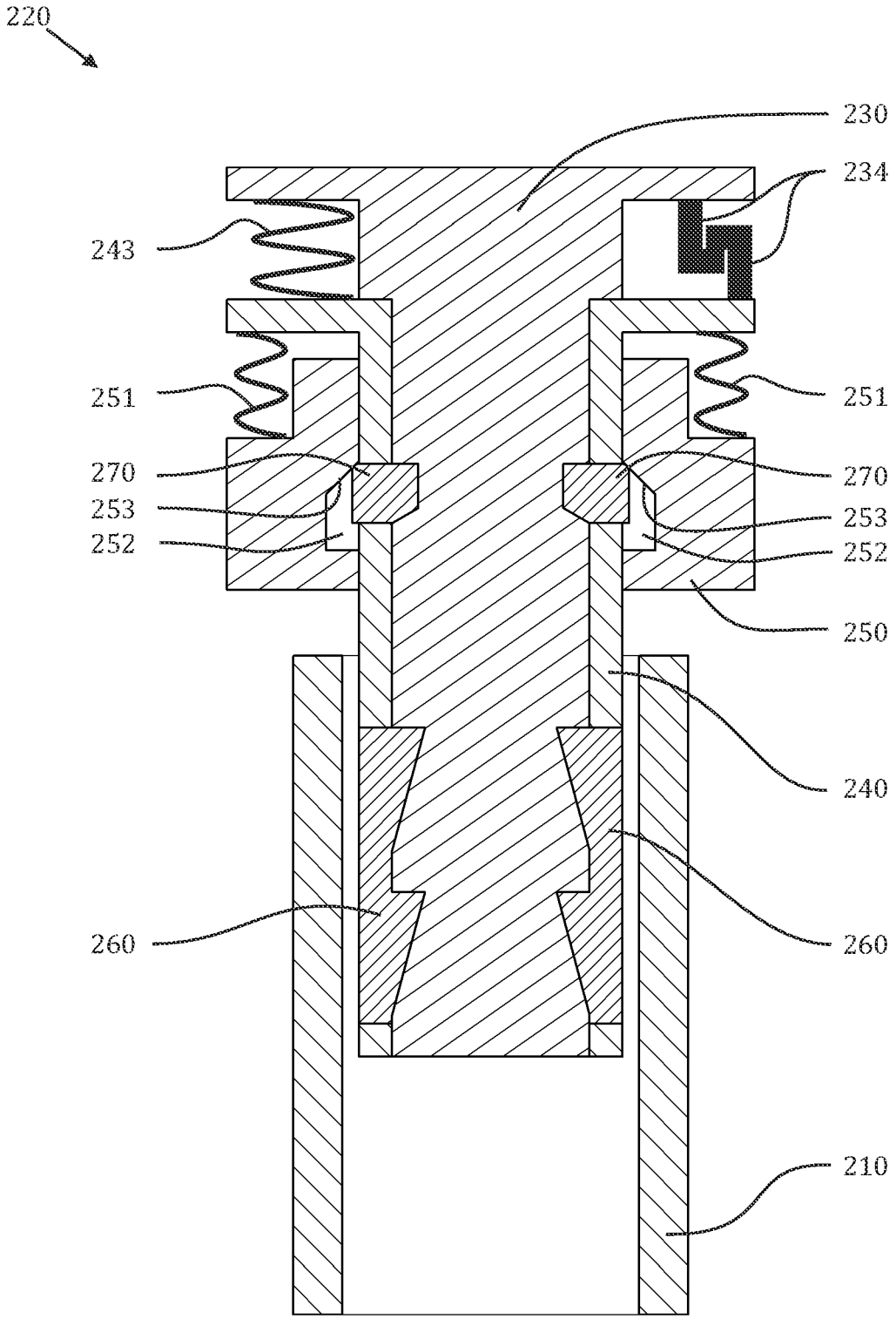
FIG. 7 is a schematic view of an exemplary embodiment of a lockout mechanism in accordance with the present disclosure and incorporated into a CRTi, with the CRTi being shown lowered onto a tubular workpiece and prior to the top of the workpiece contacting the CRT bumper.

FIG. 7 is a schematic view showing CRTi 220 as it is being lowered by the top drive of a drilling rig (not shown) onto a workpiece 210, and prior to the top of workpiece 210 contacting the CRT bumper 250 of CRTi 220. Bumper spring 251 urges CRT bumper 250 and lock pins 270 toward their respective locked positions. Cage spring 243 (which may be an air spring) is compressed between CRT mandrel 230 and CRT cage 240. Primary latch mechanism 234 is in its latched position, preventing CRT cage 240 from moving axially away from CRT mandrel 230 due to the force of compressed cage spring 243. CRT slips 260 are fully retracted away from workpiece 210.

Figure 8:
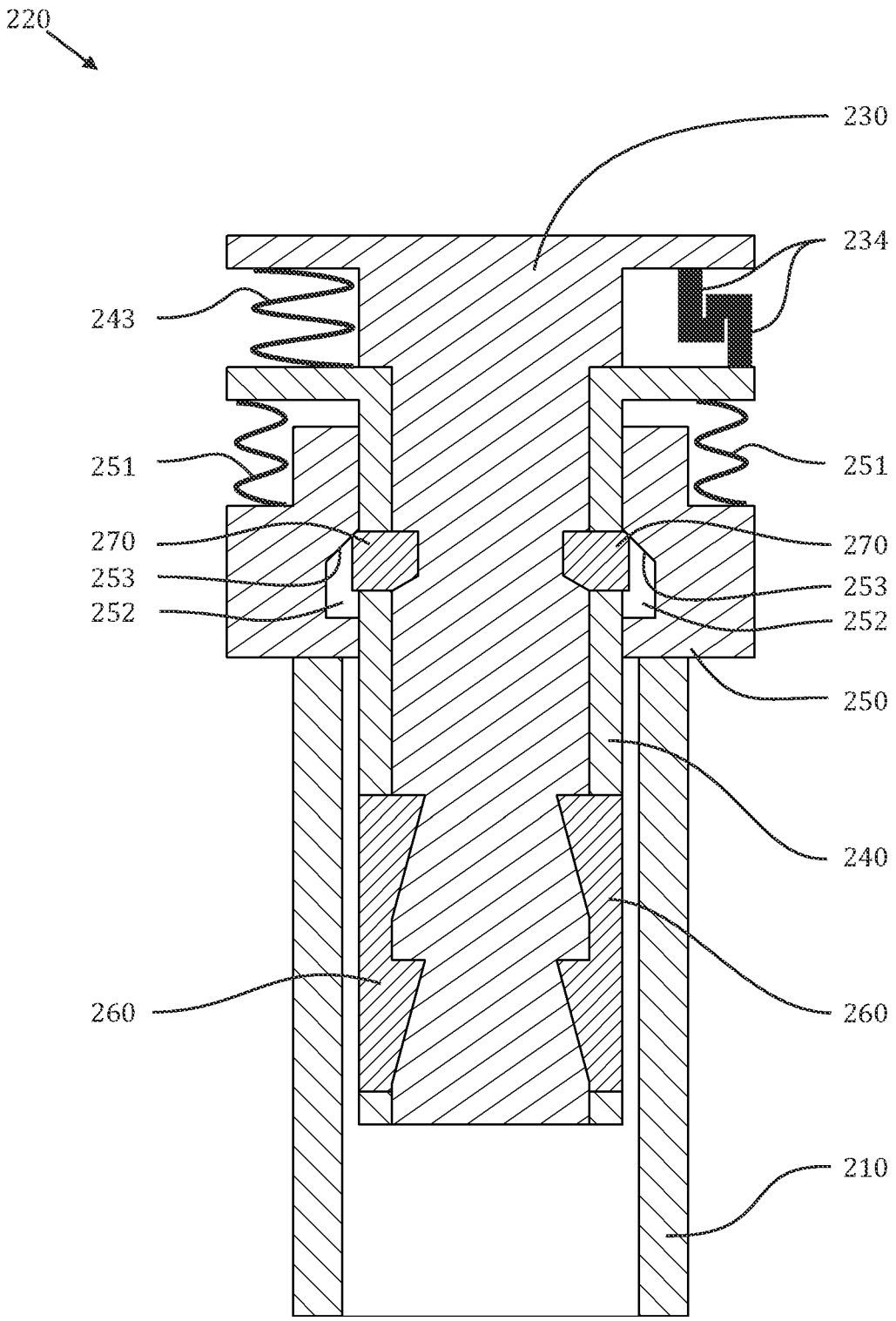
FIG. 8 is a schematic view of the lockout mechanism in FIG. 7, shown when the top of the workpiece contacts the CRT bumper without sufficient force to compress the bumper spring.

FIG. 8 is a schematic view of CRTi 220 after it has been further lowered such that the top of workpiece 210 contacts CRT bumper 250 without sufficient force to compress bumper spring 251.

Figure 9:
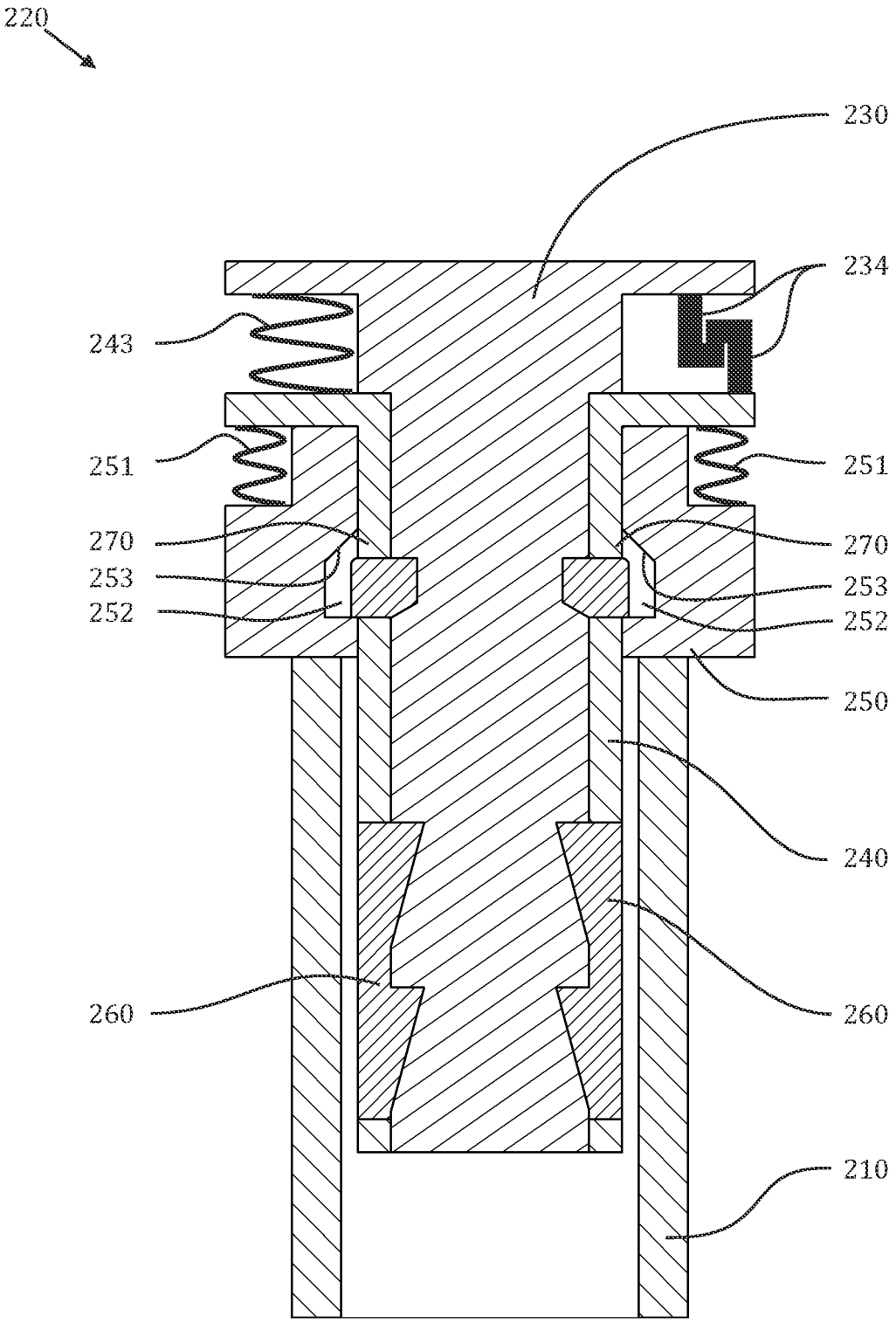
FIG. 9 is a schematic view of the lockout mechanism in FIG. 7, shown when the CRT bumper has stroked to its unlocked position and the bumper spring is compressed.

FIG. 9 is a schematic view of CRTi 220 shown at the point when CRTi 220 has been further lowered such that bumper spring 251 is compressed and CRT bumper 250 is in its unlocked position relative to CRT cage 240. Primary latch mechanism 234 (which is a rotary latch mechanism) can be unlatched by using the top drive to apply set-down load and then rotating CRT mandrel 230 in a first direction.

Figure 10:
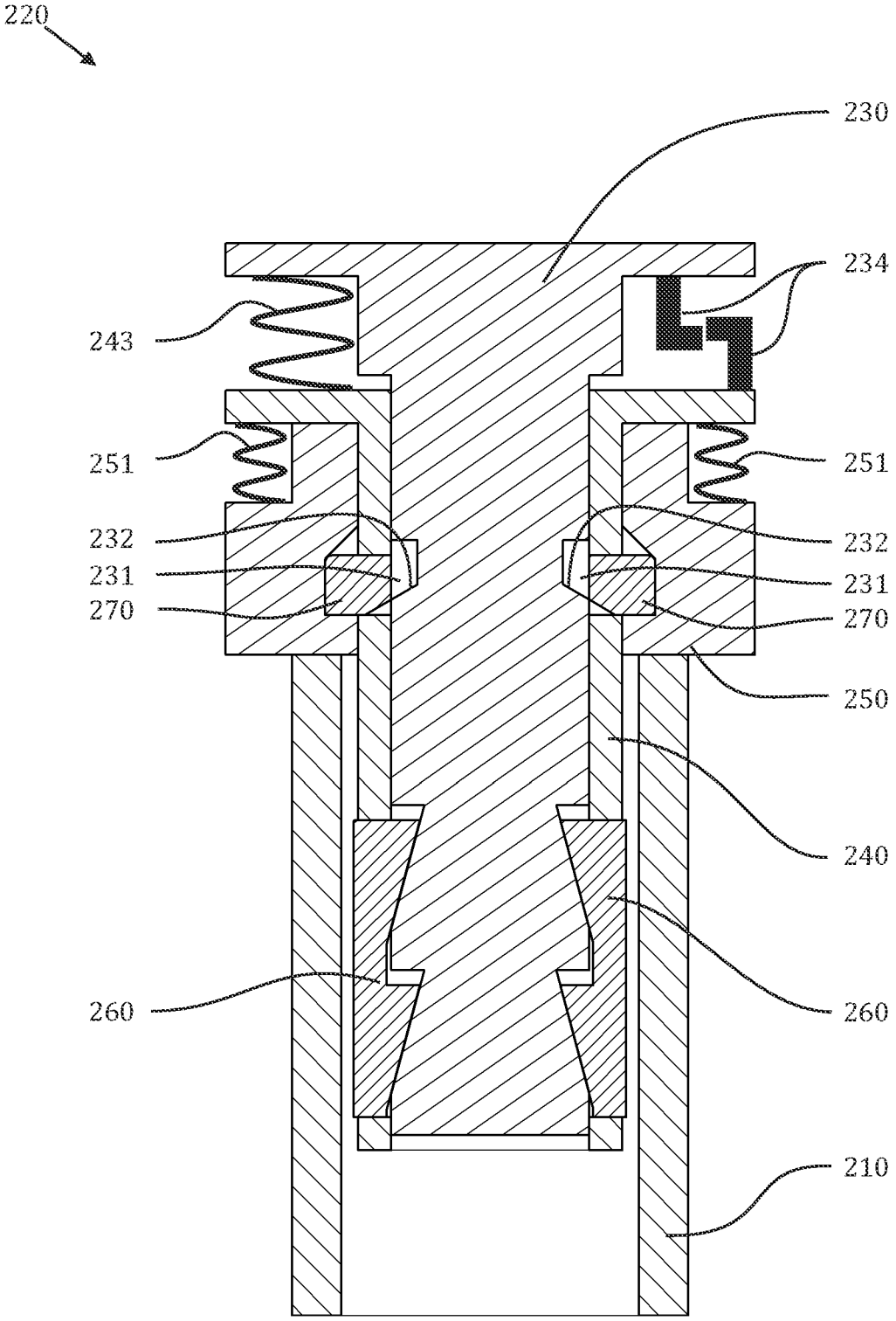
FIG. 10 is a schematic view of the lockout mechanism in FIG. 7, shown after the primary latch mechanism has been unlatched and when CRTi has been raised sufficiently to cause the lock pins to move from their locked positions to their unlocked positions.

FIG. 10 is a schematic view of CRTi 220 shown after primary latch mechanism 234 has been unlatched, and after CRTi 220 has been raised sufficiently to cause the lock pins 270 to move from their locked positions to their unlocked positions, urged by cam surfaces 232 of mandrel pockets 231 in CRT mandrel 230 and received by bumper pockets 252 in CRT bumper 250. Due to the relative axial motion between CRT mandrel 230 and CRT cage 240, CRT slips 260 extend toward workpiece 210.

Figure 11:
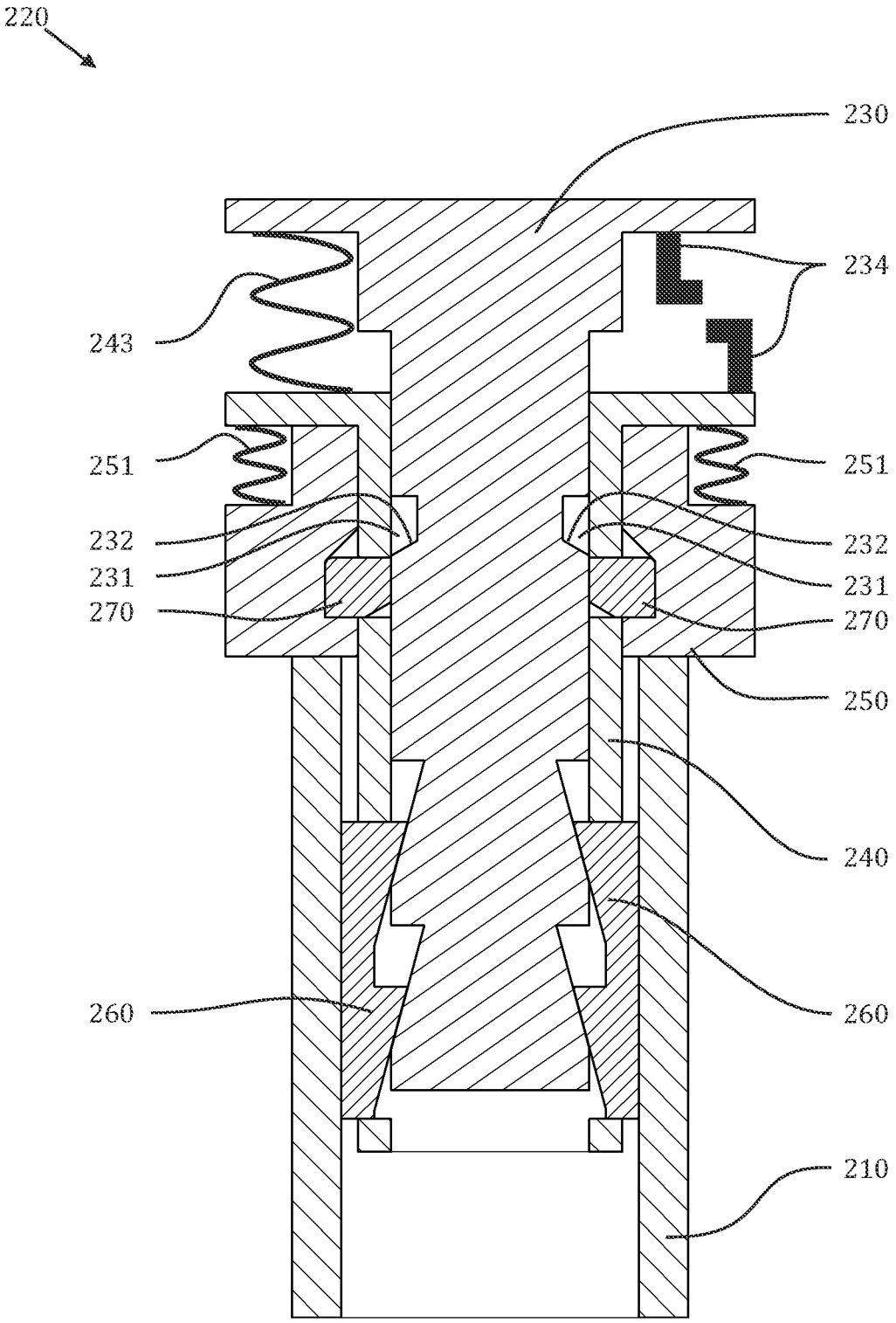
FIG. 11 is a schematic view of the lockout mechanism in FIG. 7, shown when the CRTi has been raised sufficiently to cause the slips to engage the workpiece.

FIG. 11 is a schematic view of CRTi 220 at the point where it has been raised sufficiently to cause CRT slips 260 to engage workpiece 210.

Figure 12:
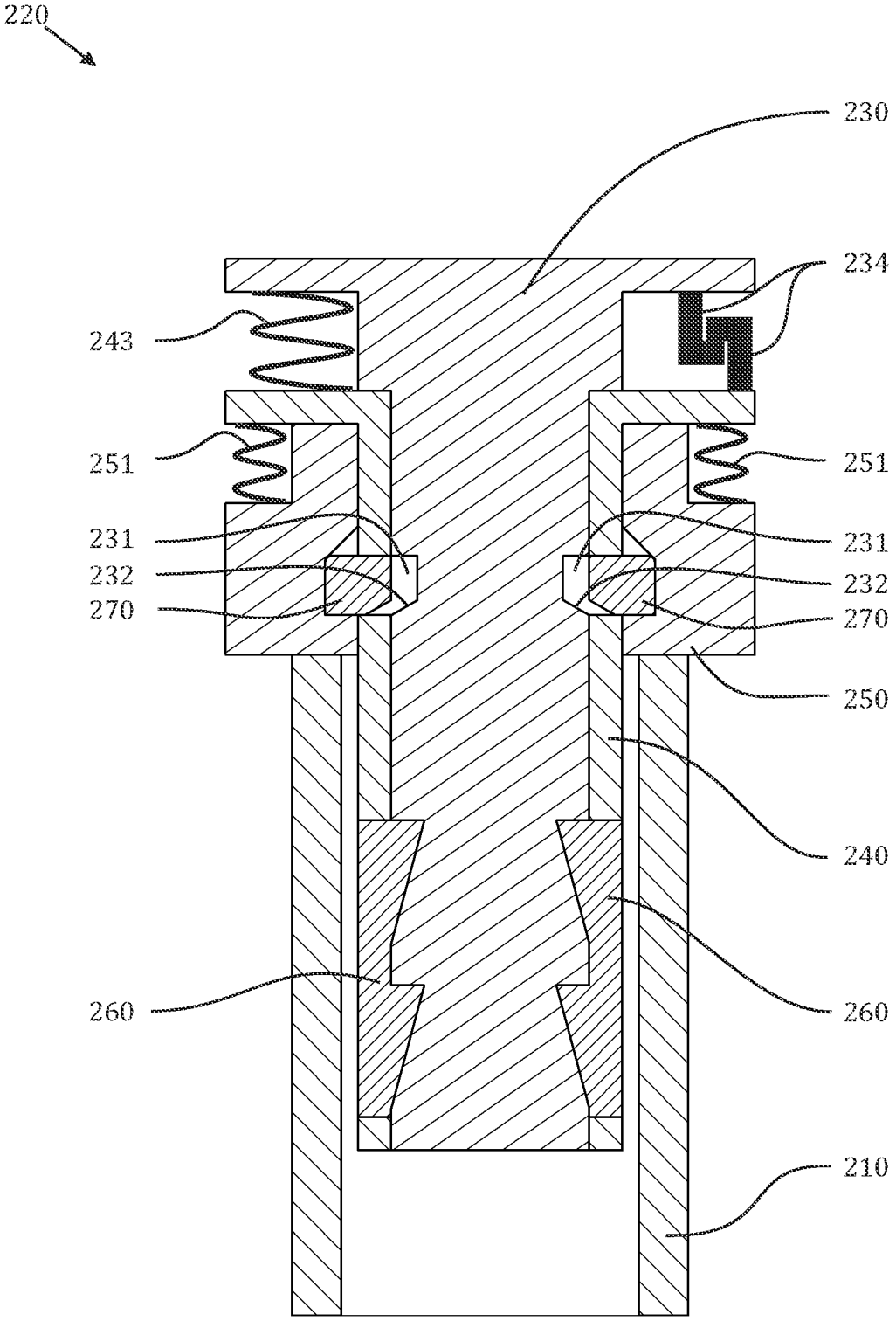
FIG. 12 is a schematic view of the lockout mechanism in FIG. 7, shown after the CRTi has been lowered to release the workpiece.

FIG. 12 is a schematic view of CRTi 220 after it has been lowered to release workpiece 210. Primary latch mechanism 234 can be latched by applying set-down load and rotating CRT mandrel 230 in a second direction. After primary latch mechanism 234 has been latched, raising CRTe 220 will allow CRT bumper 250 to move to its locked position relative to CRT cage 240, urged by bumper spring 251. Cam surfaces 253 of bumper pockets 252 urge lock pins 270 to their locked positions, received by pockets 231 of CRT mandrel 230. The state of CRTi 220 will then have returned to the state shown in FIG. 8.

If CRTi 220 is rotated while being lowered onto workpiece 210 and is misaligned with workpiece 210, then torque and axial load may be transmitted through contact between CRT slips 260 and workpiece 210 prior to workpiece 210 contacting CRT bumper 250. If the combined torque and axial load transmitted through the contact between CRT slips 260 and workpiece 210 is sufficient to unlatch the primary latch mechanism, the lockout mechanism will prevent relative axial movement between CRT cage 240 and CRT mandrel 230, which would extend CRT slips 260 toward workpiece 210.

The lockout mechanism may be configured to automatically unlock at a selected lockout release envelope determined by the force balance on lock pins 270, which includes the selected taper angles of cam surface 253 of bumper pockets 252 and cam surface 232 of mandrel pockets 231, and the axial biasing force of bumper spring 251.

Physical Embodiment Incorporated into a CRTe

Figure 13:
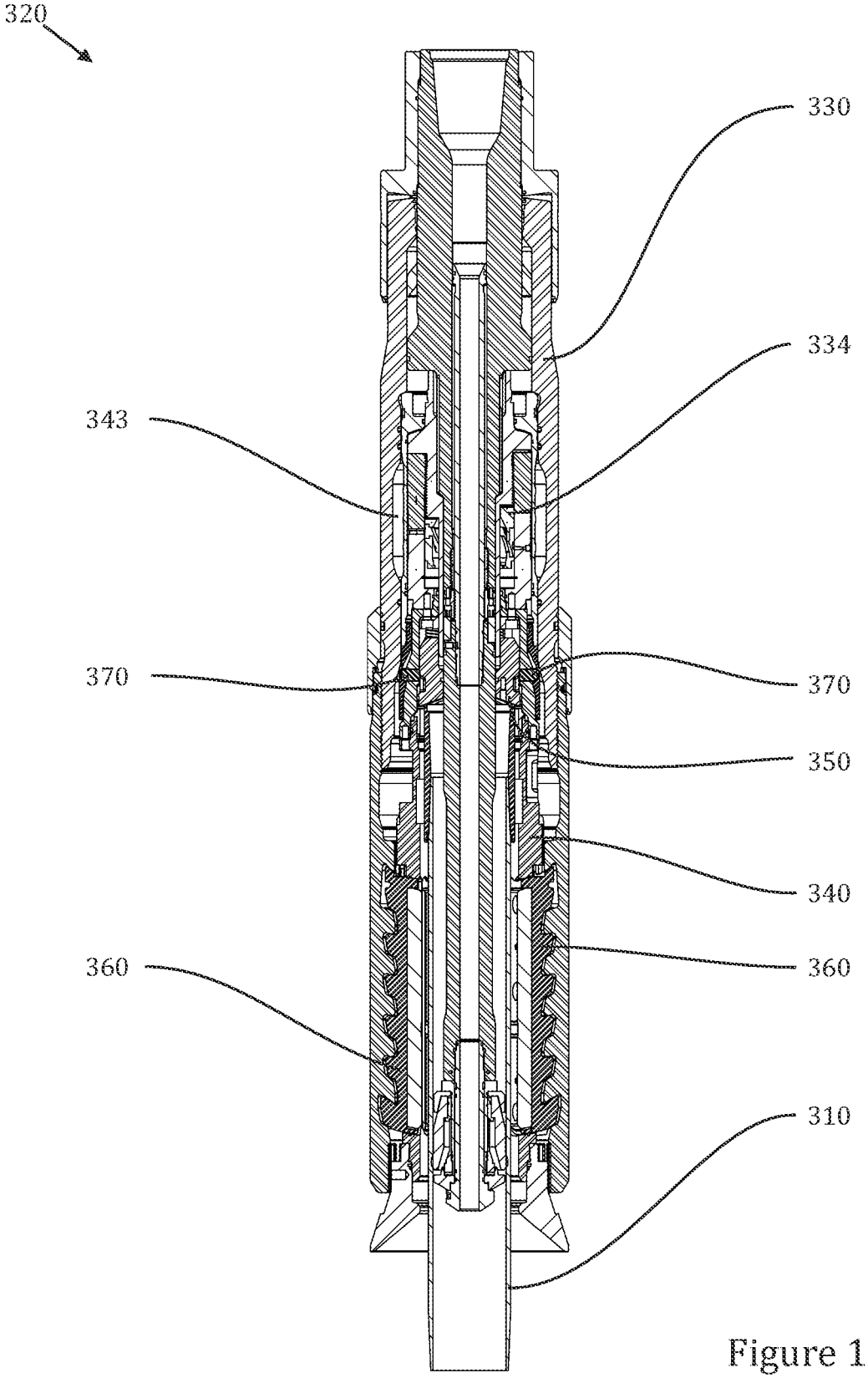
FIG. 13 is a cross-section through a CRTe generally in accordance with U.S. Pat. No. 7,909,120, similar to a CRTe shown in U.S. Pat. No. 10,081,989, and including an embodiment of a lockout mechanism in accordance with the present disclosure.

FIG. 13 is a cross-section of a CRTe 320 generally in accordance with the teachings of U.S. Pat. No. 7,909,120; similar to a CRTe shown in U.S. Pat. No. 10,081,989; and including an embodiment of a lockout mechanism in accordance with this specification. Primary latch mechanism 334 of CRTe 320 is a rotary latch similar to that shown in U.S. Pat. No. 8,424,939. Cage spring 343 is an air spring. CRT mandrel 330, CRT cage 340, and CRT slips 360 are assemblies of multiple parts. The state of CRTe 320 and this lockout mechanism in FIG. 13 is similar to the state shown in FIG. 2 for CRTe 120, with lock pins 370 in their locked positions and with workpiece 310 in initial contact with bumper 350.

Figure 14:
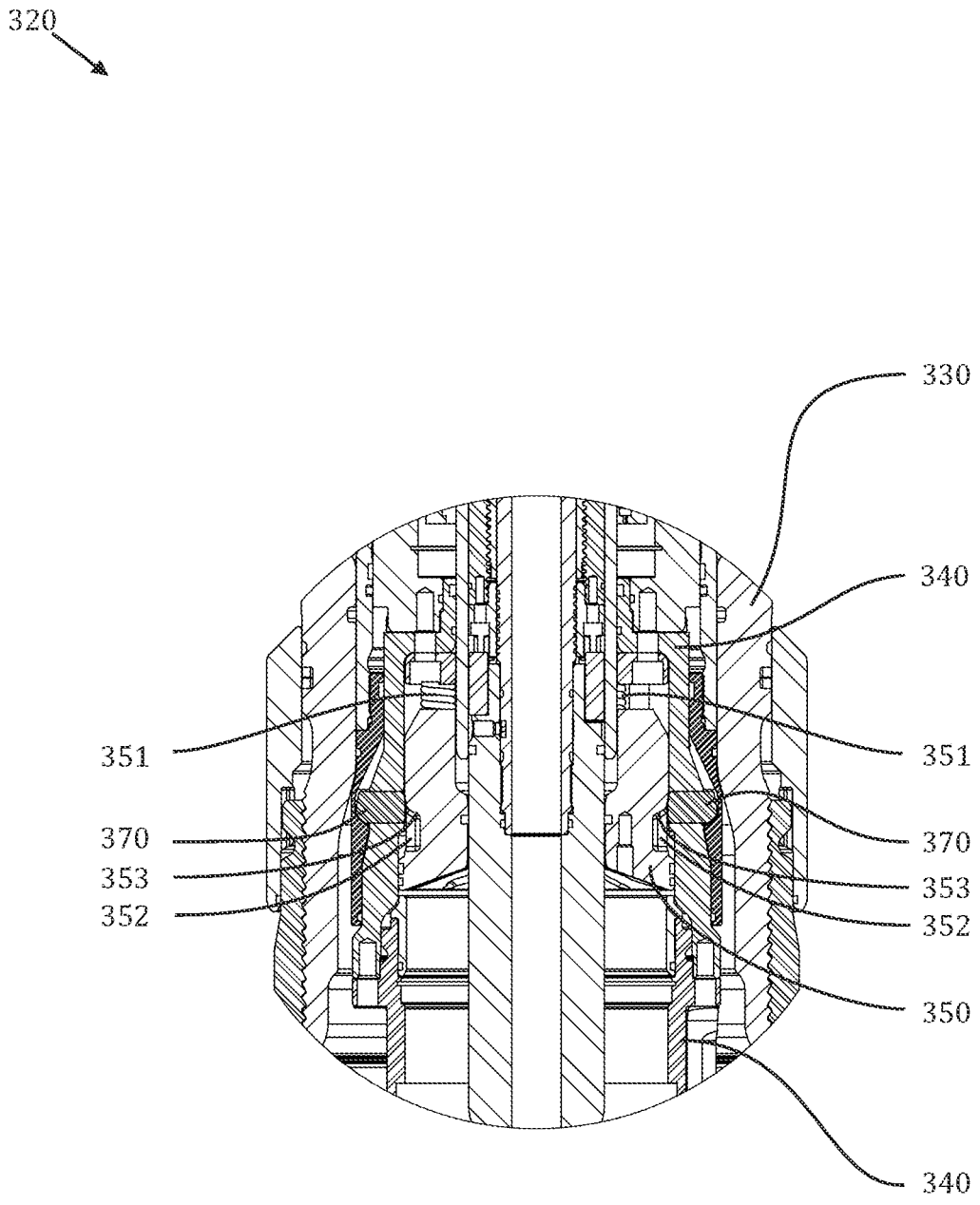
FIG. 14 is a sectional detail of the lockout mechanism of FIG. 13 along a plane showing the lock pins in their locked positions.

FIG. 14 is a sectional detail of the lockout mechanism in CRTe 320 along a plane showing lock pins 370 in their locked positions, and bumper pockets 352 in CRT bumper 350 and mandrel pockets 331 in CRT mandrel assembly 330. The state of this lockout mechanism in CRTe 320 in FIG. 14 is similar to the state shown in FIG. 2 for the lockout mechanism of CRTe 120.

Figure 15:
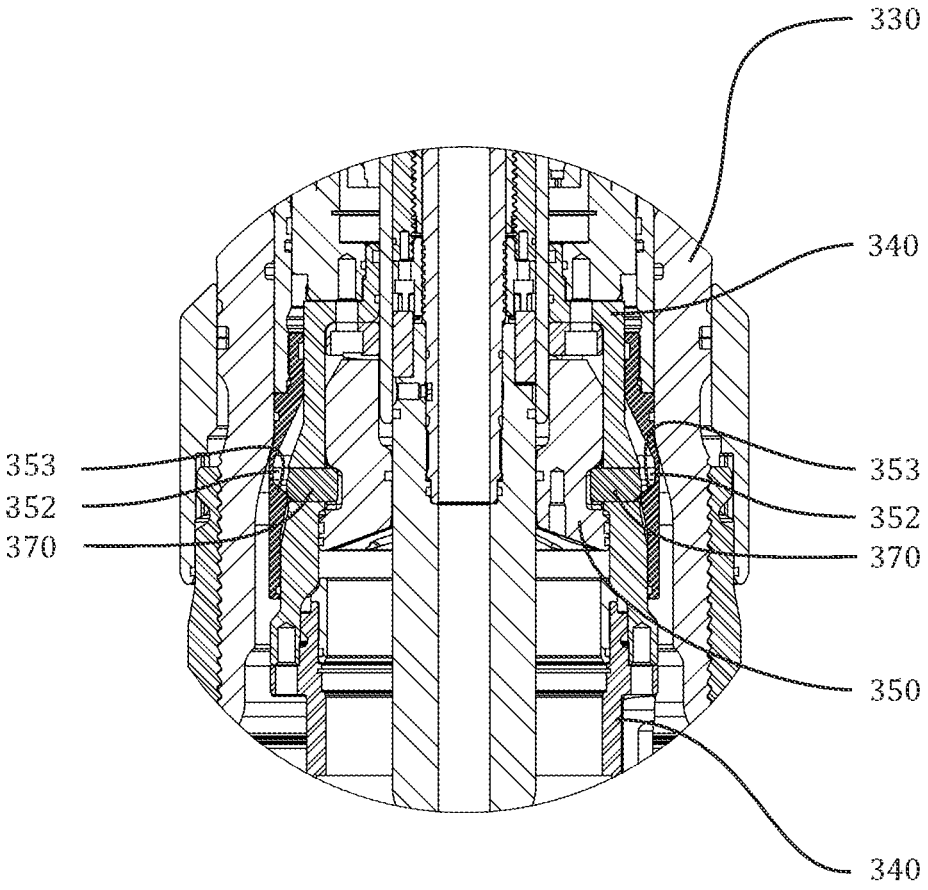
FIG. 15 is a sectional detail of the lockout mechanism of FIG. 13 along a plane showing the lock pins in their unlocked positions.

FIG. 15 is a sectional detail of the lockout mechanism in CRTe 320 along a plane showing lock pins 370 in their unlocked positions, and bumper pockets 352 in CRT bumper 350 and mandrel pockets 331 in CRT mandrel assembly 330. The state of this lockout mechanism in CRTe 320 in FIG. 15 is similar to the state shown in FIG. 4 for the lockout mechanism of CRTe 120.

Figure 16:
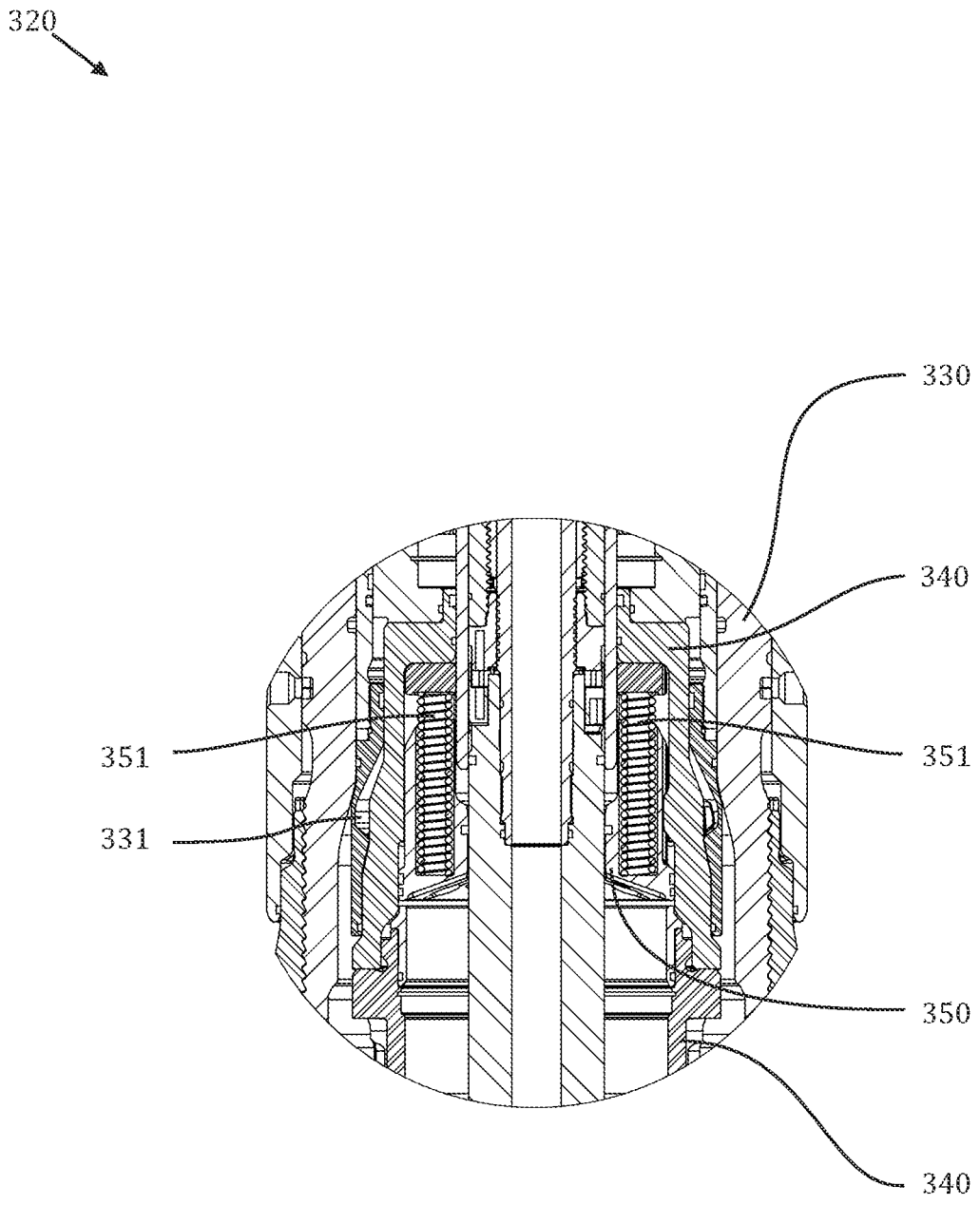
FIG. 16 is a sectional detail of the lockout mechanism of FIG. 13 along a plane showing the bumper spring.

FIG. 16 is a sectional detail of the lockout mechanism in CRTe 320 along a plane showing bumper springs 351. When a workpiece (not shown in FIG. 16) applies sufficient axial force to the lower surface of CRT bumper 350, bumper springs 351 are compressed between CRT bumper 350 and CRT cage assembly 340 as CRT bumper 350 strokes from its locked position to its unlocked position.

Figure 17:
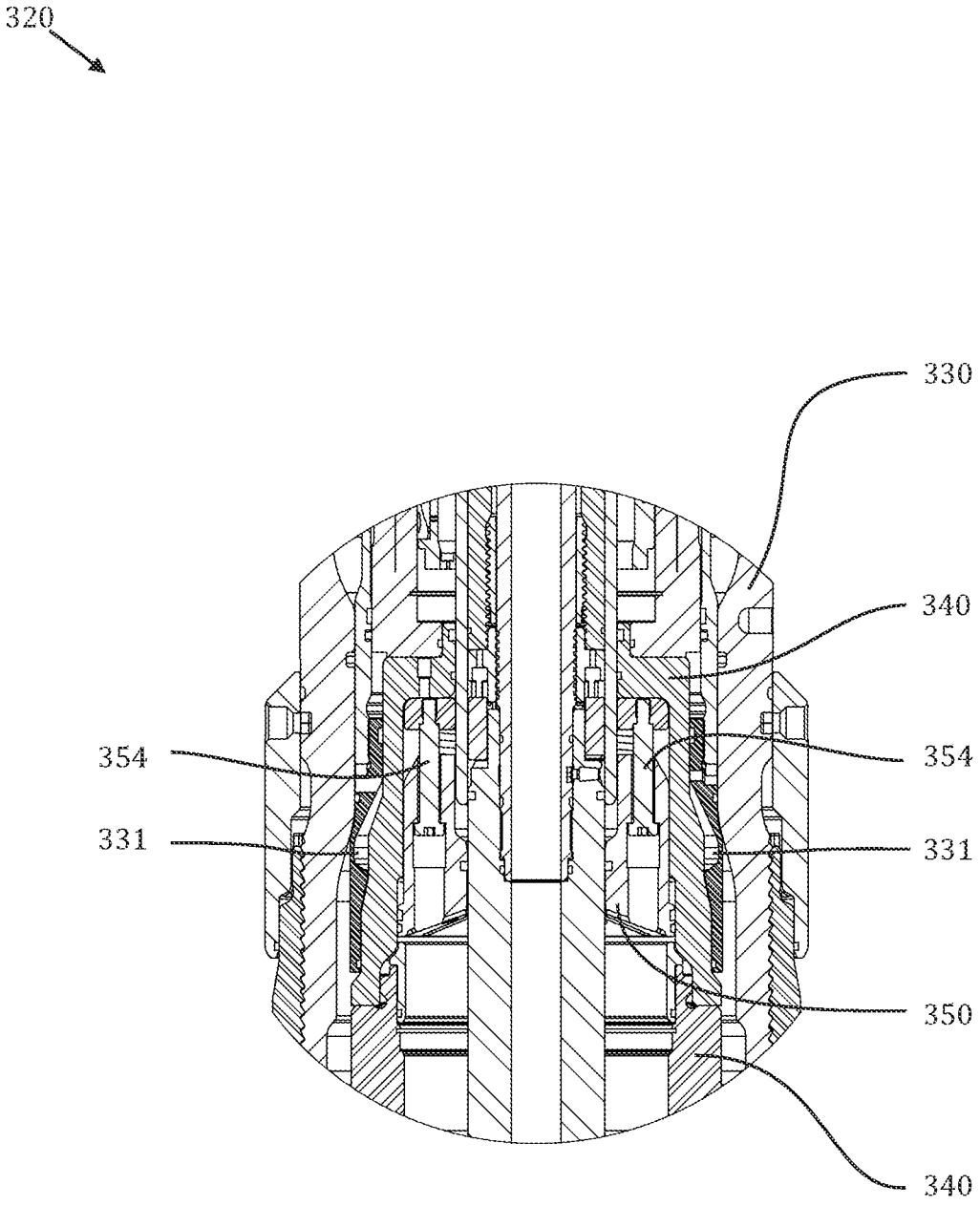
FIG. 17 is a sectional detail of the lockout mechanism of FIG. 13 along a plane showing shoulder bolts securing the CRT bumper to the CRT cage assembly.

FIG. 17 is a sectional detail of the lockout mechanism in CRTe 320 along a plane showing shoulder bolts 354 securing CRT bumper 350 to CRT cage assembly 340.

Secondary Latch Mechanism with Primary Latch Release Function

Figure 18:
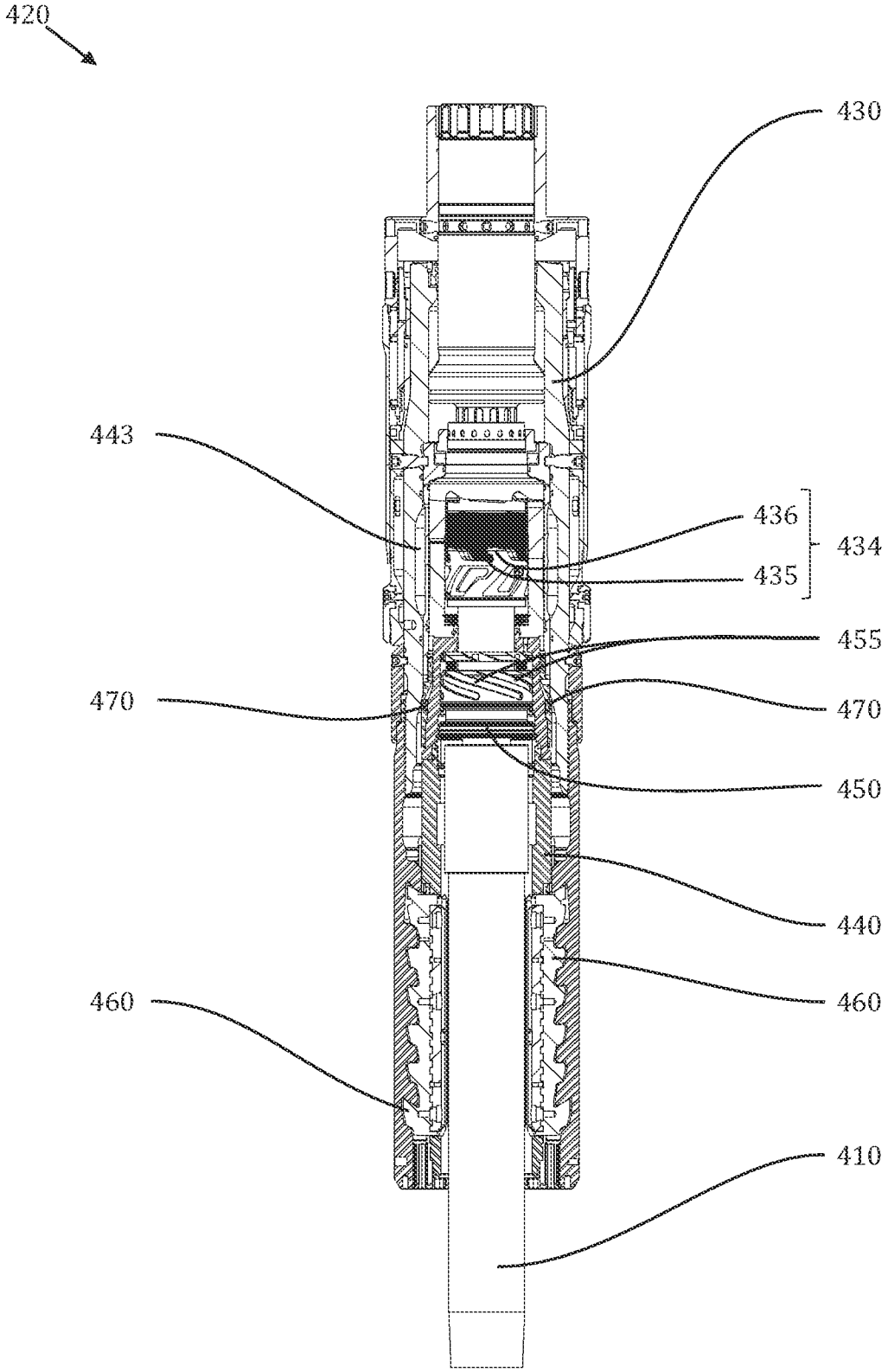
FIG. 18 is a partial cross-section through a CRTe generally in accordance with U.S. Pat. No. 7,909,120, similar to a CRTe shown in WO 2020/146936 A1, and including another embodiment of a lockout mechanism in accordance with the present disclosure. The radially outward parts are sectioned and the parts near the central axis are not sectioned.

FIG. 18 is a cross-section through a CRTe 420 generally in accordance with the teachings of U.S. Pat. No. 7,909,120 (similar to a CRTe shown in U.S. Pat. No. 10,081,989) and including another embodiment of a lockout mechanism in accordance with the present disclosure. Primary latch mechanism 434 of CRTe 420 is a rotary latch similar to that shown in U.S. Pat. No. 8,424,939, comprising upper latch hooks 435 and lower latch hooks 436. Cage spring 443 is an air spring. CRT mandrel 430, CRT cage 440, and CRT slips 460 are assemblies of multiple parts. The state of CRTe 420 and the lockout mechanism in FIG. 18 is similar to the state shown in FIG. 1 for CRTe 120, with lock pins 470 in their locked positions, primary latch mechanism 434 in its latched position, and with workpiece 410 prior to initial contact with CRT bumper 450.

Figure 19:
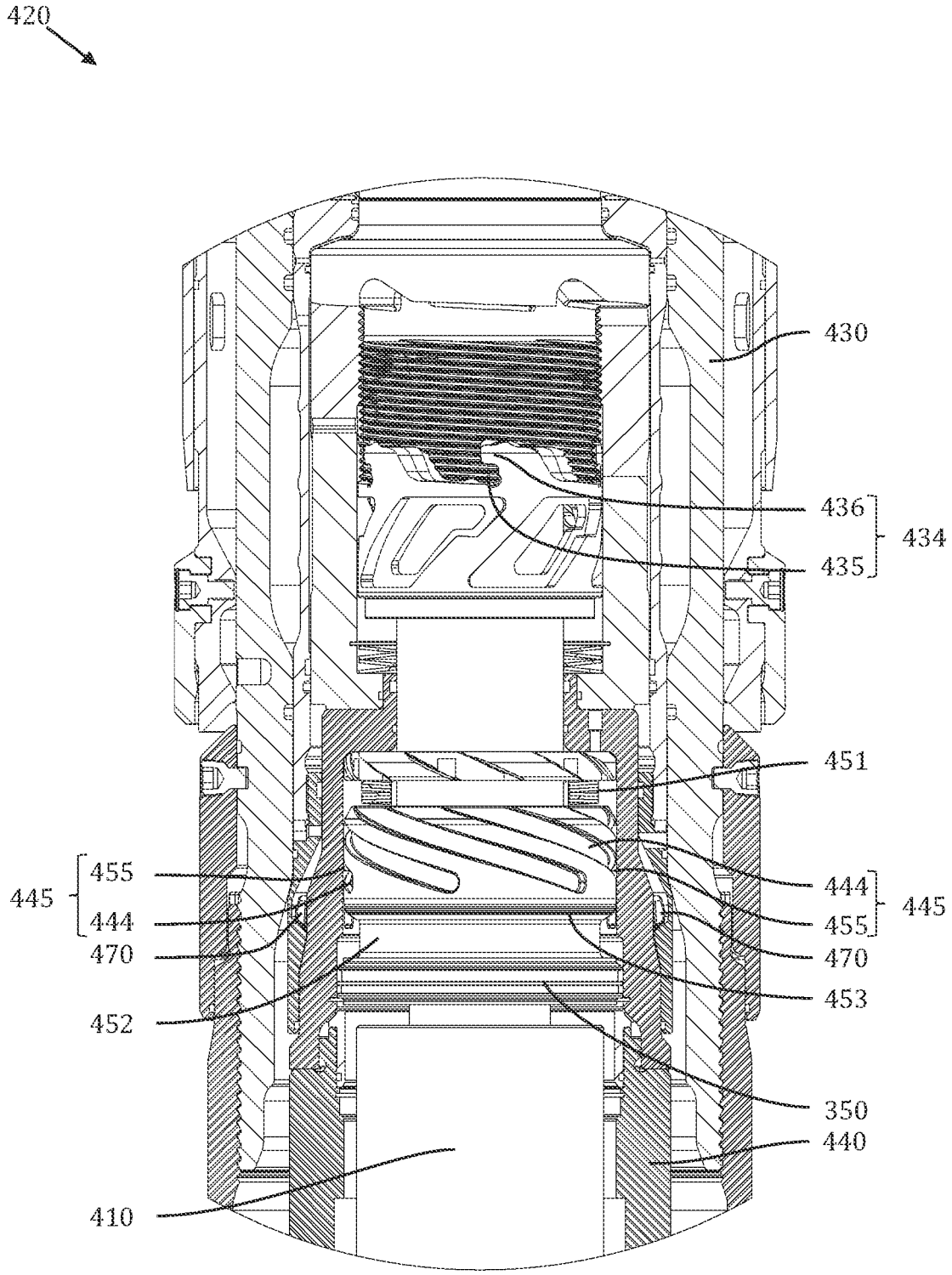
FIG. 19 is a partial sectional detail of the lockout mechanism and rotary (primary) latch mechanism of FIG. 18 showing the lock pins in their locked positions and the primary latch mechanism in its latched position.

FIG. 19 is a partial sectional detail of the lockout mechanism and primary latch mechanism 434 in CRTe 420, showing lock pins 470 in their locked positions; primary latch mechanism 434 in its latched position; bumper pockets 452 in CRT bumper 450; and mandrel pockets 431 in CRT mandrel assembly 430. The state of this lockout mechanism in CRTe 420 in FIG. 19 is similar to the state shown in FIG. 1 for the lockout mechanism of CRTe 120.

Figure 20:
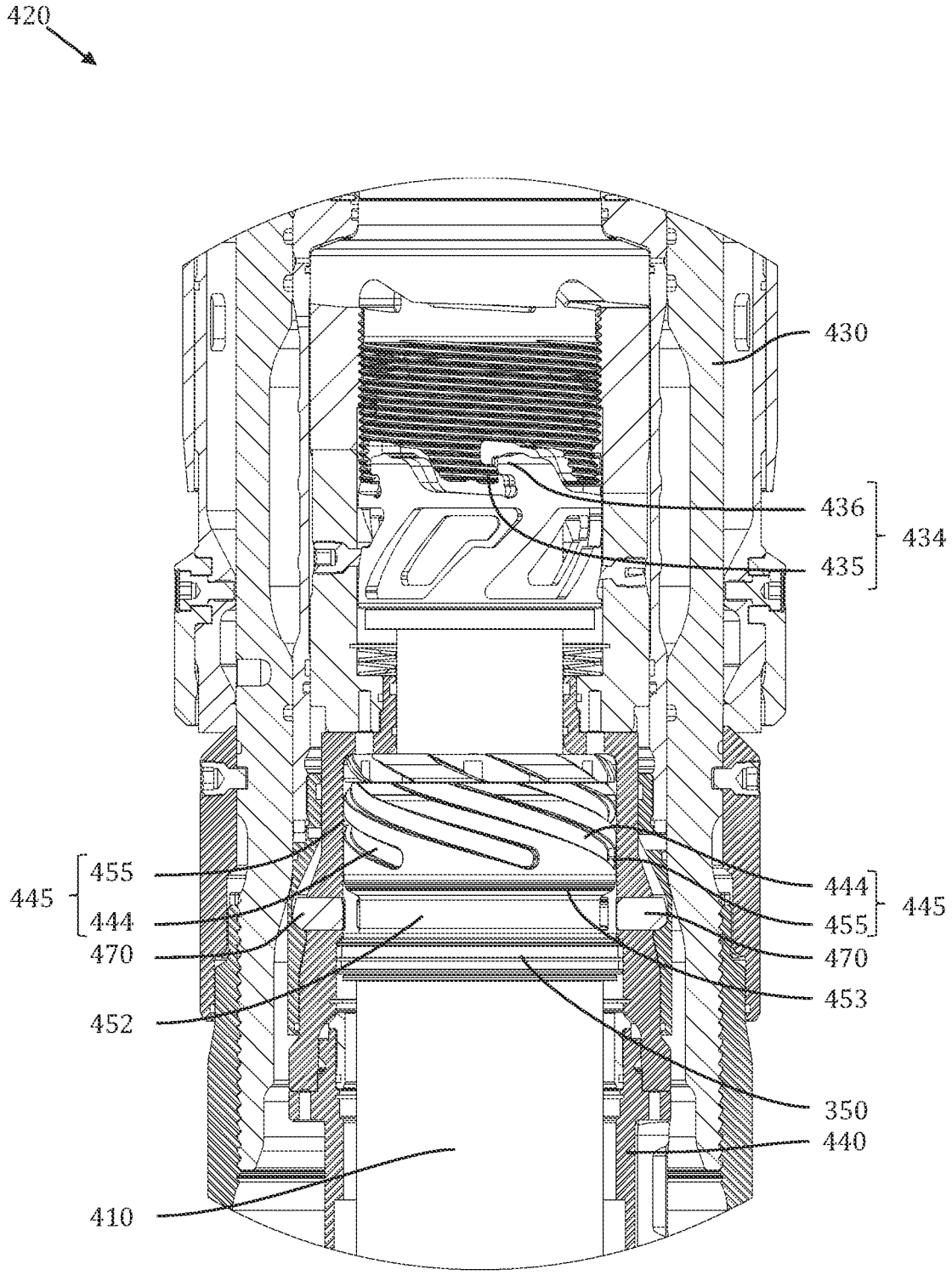
FIG. 20 is a partial sectional detail of the lockout mechanism and rotary (primary) latch mechanism of FIG. 18 showing the lock pins in their unlocked positions and the primary latch mechanism in its unlatched position.

FIG. 20 is a partial sectional detail of the lockout mechanism and primary latch mechanism 434 of CRTe 420 showing lock pins 470 in their unlocked positions; primary latch mechanism 434 in its unlatched position; bumper pockets 452 in CRT bumper 450; and CRT mandrel pockets 431 in CRT mandrel assembly 430. The state of this lockout mechanism in CRTe 420 in FIG. 20 is similar to the state shown in FIG. 3 for the lockout mechanism of CRTe 120.

The lockout mechanism of CRTe 420 is configured with a mechanical linkage 445 acting between CRT bumper 450 and primary latch mechanism 434 such that axial force applied by workpiece 410 on CRT bumper 450 in excess of the axial biasing force of bumper spring 451 generates torque urging primary latch mechanism 434 to unlatch. Mechanical linkage 445 comprises track followers 444 on a radially-inward surface of CRT cage 440 that engage helical tracks 455 in a radially-outward surface of CRT bumper 450. The torque generated by mechanical linkage 445 is transmitted from track followers 444 to CRT cage 440 and then to lower latch hooks 436 of primary latch mechanism 434. The torque generated by mechanical linkage 445 is also transmitted from helical tracks 455 in CRT bumper 450 to workpiece 410 through frictional contact with CRT bumper 450 to the drilling rig (not shown) to the upper end of CRTe 420, and then to upper latch hooks 435 of primary latch mechanism 434.

It will be readily appreciated by those skilled in the art that various modifications to embodiments in accordance with the present disclosure may be devised without departing from the scope of the present teachings, including modifications that use equivalent structures or materials hereafter conceived or developed.

It is especially to be understood that the scope of the present disclosure is not intended to be limited to described or illustrated embodiments, and that the substitution of a variant of any claimed or illustrated element or feature, without any substantial resultant change in functionality, will not constitute a departure from the scope of the disclosure.

In this patent document, any form of the word "comprise" is to be understood in its non-limiting sense to mean that any element or feature following such word is included, but elements or features not specifically mentioned are not excluded. A reference to an element or feature by the indefinite article "a" does not exclude the possibility that more than one such element or feature is present, unless the context clearly requires that there be one and only one such element or feature.

Any use herein of any form of the terms "connect", "engage", "couple", "attach", or any other term describing an interaction between elements is not meant to limit the interaction to direct interaction between the subject elements, and may also include indirect interaction between the elements such as through secondary or intermediary structure.

Relational and conformational terms such as (but not limited to) "axial" and "cylindrical" are not intended to denote or require absolute mathematical or geometrical precision. Accordingly, such terms are to be understood as denoting or requiring substantial precision only (e.g., "substantially axial" or "generally cylindrical") unless the context clearly requires otherwise.

Unless specifically noted otherwise, any reference to an element being "generally cylindrical" is intended to denote that the element in question would appear substantially cylindrical in transverse cross-section, although the cross-sectional configuration of the element may vary along its length.

Wherever used in this document, the terms "typical" and "typically" are to be understood and interpreted in the sense of being representative of common usage or practice, and are not to be understood or interpreted as implying essentiality or invariability.

LIST OF ILLUSTRATED ELEMENTS

| Element Number | Description |
|---|---|
| 110 | Workpiece |
| 120 | CRTe |
| 130 | CRT mandrel |
| 131 | Mandrel pocket in CRT mandrel 130 |
| 132 | Cam surface of mandrel pocket 131 |
| 134 | Primary latch mechanism |
| 140 | CRT cage |
| 143 | Cage spring |
| 150 | CRT bumper |
| 151 | Bumper spring |

-continued

| Element Number | Description |
|---|---|
| 152 | Bumper pocket in CRT bumper 150 |
| 153 | Cam surface of bumper pocket 152 |
| 160 | CRT slip |
| 170 | Lock pin |
| 210 | Workpiece |
| 220 | CRTi |
| 230 | CRT mandrel |
| 231 | Mandrel pocket in CRT mandrel 230 |
| 232 | Cam surface of mandrel pocket 231 |
| 234 | Primary latch mechanism |
| 240 | CRT cage |
| 243 | Cage spring |
| 250 | CRT bumper |
| 251 | Bumper spring |
| 252 | Bumper pocket in CRT bumper 250 |
| 253 | Cam surface of bumper pocket 252 |
| 260 | CRT slip |
| 270 | Lock pin |
| 310 | Workpiece |
| 320 | CRTi |
| 330 | CRT mandrel |
| 331 | Mandrel pocket in CRT mandrel 330 |
| 332 | Cam surface of mandrel pocket 331 |
| 334 | Primary latch mechanism |
| 340 | CRT cage |
| 343 | Cage spring |
| 350 | CRT bumper |
| 351 | Bumper spring |
| 352 | Bumper pocket in CRT bumper 350 |
| 353 | Cam surface of bumper pocket 352 |
| 354 | Shoulder bolt |
| 360 | CRT slip |
| 370 | Lock pin |
| 410 | Workpiece |
| 420 | CRTi |
| 430 | CRT mandrel |
| 431 | Mandrel pocket in CRT mandrel 430 |
| 432 | Cam surface of mandrel pocket 431 |
| 434 | Primary latch mechanism |
| 435 | Upper latch hooks |
| 436 | Lower latch hooks |
| 440 | CRT cage |
| 443 | Cage spring |
| 444 | Track follower |
| 445 | Mechanical linkage |
| 450 | CRT bumper |
| 451 | Bumper spring |
| 452 | Bumper pocket in CRT bumper 450 |
| 453 | Cam surface of bumper pocket 452 |
| 454 | Shoulder bolt |
| 455 | Helical track |
| 460 | CRT slip |
| 470 | Lock pin |

What is claimed is:

1. A lockout mechanism for a casing running tool (CRT) for gripping a tubular workpiece, wherein said CRT has a longitudinal axis and incorporates a generally cylindrical CRT cage having a CRT cage wall; a generally cylindrical CRT mandrel coaxially aligned with the CRT cage; and CRT slips carried by the CRT cage, said CRT slips being radially movable in response to relative axial movement between the CRT mandrel and the CRT cage to grip a selected surface of the workpiece; and a primary CRT latch mechanism; and wherein said lockout mechanism comprises:

(a) a CRT bumper slidingly mounted to the CRT cage and operable to axially stroke between a locked position and an unlocked position, with said CRT bumper being biased by a bumper spring configured to provide an axial biasing force sufficient to resist a selected axial load when the CRT bumper is moved from the locked position to the unlocked position by contact with the end of the workpiece;

(b) one or more lock pins radially slidingly disposed in corresponding lock pin guide holes through the CRT cage wall and movable between a locked position, corresponding to the locked position of the CRT bumper, in which the lock pins engage corresponding mandrel pockets formed in the CRT mandrel, and an unlocked position, corresponding to the unlocked position of the CRT bumper, in which the lock pins engage corresponding bumper pockets formed in the CRT bumper;

wherein:

(c) the mandrel pockets and the lock pin guide holes are arranged such that the lock pins, when in their locked positions, will prevent relative axial movement between the CRT mandrel and the CRT cage, and will hold the CRT cage in an axial position relative to the CRT mandrel wherein the CRT slips are retracted away from the workpiece;

(d) each mandrel pocket includes a cam surface configured to induce movement of the lock pins toward their unlocked positions when the CRT cage moves axially relative to the CRT mandrel in the direction that causes the CRT slips to engage the workpiece;

(e) each bumper pocket includes a cam surface configured to induce movement of the lock pins toward their locked position in response to the axial force applied to the CRT bumper by the bumper spring;

(f) the axial biasing force of the bumper spring is selected such that the bumper spring can apply sufficient axial force to the CRT bumper to hold the lock pins in their locked positions when no workpiece is in contact with the CRT bumper; and (g) the application of an axial force by the workpiece to the CRT bumper sufficient to axially stroke the CRT bumper and overcome the axial biasing force of the bumper spring will move the CRT bumper to its unlocked position, thereby allowing the lock pins to be moved from their locked positions to their unlocked positions, and into the corresponding bumper pockets.

2. The lockout mechanism as in claim 1, wherein the selected surface of the workpiece is an external surface of the workpiece.

3. The lockout mechanism as in claim 1, wherein the selected surface of the workpiece is an internal surface of the workpiece.

4. The lockout mechanism as in claim 1 further comprising a mechanical linkage acting between the bumper and the CRT primary latch mechanism such that axial force applied by the workpiece on the bumper in excess of the axial biasing force of the bumper spring will generate torque urging the CRT primary latch mechanism to unlatch.

5. The lockout mechanism as in claim 4 wherein the mechanical linkage comprises mating helical threads.

6. The lockout mechanism as in claim 4 wherein the mechanical linkage comprises a helical track-follower.

7. The lockout mechanism as in claim 1 wherein the taper angles of the cam surfaces of the bumper pockets and the mandrel pockets and the axial biasing force of the bumper spring are selected so that the lockout mechanism will automatically unlock in response to the application of a selected combination of torque and axial load.

8. The lockout mechanism as in claim 1 wherein the bumper spring is selected from the group consisting of coil springs, wave springs, Belleville washer stacks, air springs, and hydraulic chambers connected to accumulators.

* * * * *